US010520238B2

(12) United States Patent
Li et al.

(10) Patent No.: US 10,520,238 B2
(45) Date of Patent: Dec. 31, 2019

(54) PARTITION REFRIGERATION CONTROL METHOD AND DEVICE FOR REFRIGERATING CHAMBER OF REFRIGERATOR

(71) Applicant: QINGDAO HAIER JOINT STOCK CO., LTD., Qingdao, Shandong Province (CN)

(72) Inventors: Chunyang Li, Qingdao (CN); Wenyin Zhu, Qingdao (CN); Haibo Tao, Qingdao (CN); Ming Wang, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 42 days.

(21) Appl. No.: 15/578,710

(22) PCT Filed: Sep. 28, 2015

(86) PCT No.: PCT/CN2015/090981
§ 371 (c)(1),
(2) Date: Nov. 30, 2017

(87) PCT Pub. No.: WO2016/206216
PCT Pub. Date: Dec. 29, 2016

(65) Prior Publication Data

US 2018/0156518 A1 Jun. 7, 2018

(30) Foreign Application Priority Data

Jun. 26, 2015 (CN) ..... 2015 1 0367371

(51) Int. Cl.
*F25D 17/06* (2006.01)
*F25D 29/00* (2006.01)

(52) U.S. Cl.
CPC ..... *F25D 17/06* (2013.01); *F25D 29/00* (2013.01); *F25D 29/005* (2013.01);
(Continued)

(58) Field of Classification Search
CPC ..... F25D 17/06; F25D 17/062; F25D 19/00; F25D 29/00; F25D 29/005; F25D 2400/28; F25D 2700/16
See application file for complete search history.

(56) References Cited

U.S. PATENT DOCUMENTS 5,269,152 A 12/1993 Park
2004/0031274 A1* 2/2004 Cho ..... F25D 29/00 62/126
(Continued)

FOREIGN PATENT DOCUMENTS

CN 88100827 A 10/1988
CN 1151512 A 6/1997
(Continued)

*Primary Examiner* — Marc E Norman
(74) *Attorney, Agent, or Firm* — Cheng-Ju Chiang

(57) ABSTRACT

The present invention provides a partition refrigeration control method and device for a refrigerating chamber of a refrigerator. The partition refrigeration control method comprises: determining that the refrigerating chamber enters a refrigeration state; acquiring the temperatures, sensed by an infrared sensor, of the items stored in the plurality of item storage compartments; comparing the temperature of the item stored in each item storage compartment with a corresponding preset area refrigeration start temperature threshold of each item storage compartment; setting a refrigeration state identifier corresponding to the item storage compartment in which the temperature of the item is higher than the corresponding area refrigeration start temperature threshold as start; and driving the air blowing splitter to operate in a
(Continued)

state of providing the cooling air flow to the item storage compartment whose refrigeration state identifier is start.

18 Claims, 16 Drawing Sheets

(52) U.S. Cl.
CPC ..... *F25B 2600/112* (2013.01); *F25D 2400/28* (2013.01); *F25D 2700/02* (2013.01); *F25D 2700/16* (2013.01)

(56) References Cited

U.S. PATENT DOCUMENTS

| | | | | |
|---|---|---|---|---|
| 2009/0029016 | A1* | 1/2009 | Pfister | F25D 11/02 426/231 |
| 2016/0370107 | A1* | 12/2016 | Moon | F25D 17/062 |
| 2018/0080702 | A1* | 3/2018 | Wilson | F25D 17/062 |
| 2018/0180353 | A1* | 6/2018 | Shuntich | F25D 17/06 |

FOREIGN PATENT DOCUMENTS

| | | | |
|---|---|---|---|
| CN | 1174979 | A | 3/1998 |
| CN | 1475733 | A | 2/2004 |
| CN | 1532502 | A | 9/2004 |
| CN | 203837400 | U | 9/2014 |
| CN | 104879983 | A | 9/2015 |
| JP | H10-205951 | A | 8/1998 |

* cited by examiner

PARTITION REFRIGERATION CONTROL METHOD AND DEVICE FOR REFRIGERATING CHAMBER OF REFRIGERATOR

CROSS REFERENCE TO RELATED APPLICATIONS

The present application is a 35 U.S.C. § 371 National Phase conversion of International (PCT) Patent Application No. PCT/CN2015/090981, filed on Sep. 28, 2015, which claims benefit of Chinese Application No. 201510367371.8, filed on Jun. 26, 2015, the disclosure of which is incorporated by reference herein. The PCT International Patent Application was filed and published in Chinese.

FIELD OF THE INVENTION

The present invention relates to refrigerator control, and in particular, to a partition refrigeration control method and device for a refrigerating chamber of a refrigerator.

BACKGROUND OF THE INVENTION

Temperatures around temperature sensors arranged inside refrigerating chambers of existing refrigerators are generally sensed by the temperature sensors, and serve as a basis for refrigeration control.

However, when the refrigerator is controlled through this control mode, refrigeration of the refrigerating chamber of the refrigerator is started once the temperature sensed by the temperature sensor is higher than a preset valve. In a case where the refrigerating chamber is divided into a plurality of relatively separate item storage compartments via shelving partition plates, the temperature of an item storage compartment where an item is just placed may be higher than that of another item storage compartment. If a temperature control method of the existing refrigerator is adopted, it is required to refrigerate the whole refrigerating chamber. As a result, electric energy is wasted, and particularly, is seriously wasted when the refrigerating chamber is larger in volume.

In addition, in an actual use process of the refrigerating chamber of the refrigerator, a user often needs to place items in the refrigerator or take them out of the refrigerator. Generally, the temperature of an item just placed in the refrigerator is relatively high, and it requires certain time to conduct the temperature of the item to the whole refrigerating chamber in a heat radiation manner. The temperature sensed by the temperature sensor rises after the temperature of the item is conducted to the environment of the refrigerating chamber, and then a cold source device such as a compressor is started to refrigerate the refrigerating chamber. However, in this process, the temperature of the item may be conducted to another item in contact with the same, so that the temperature of the food stored in the refrigerator changes, resulting in nutrient loss and a poor storage effect.

SUMMARY OF THE INVENTION

One object of the present invention is to reduce electric energy consumed by refrigeration of a refrigerator.

Another object of the present invention is to improve an item storage effect of the refrigerator.

Particularly, the present invention provides a partition refrigeration control method and device for a refrigerating chamber of a refrigerator. The refrigerating chamber of the refrigerator is divided into a plurality of item storage compartments; an infrared sensor for sensing temperatures of items stored in the item storage compartments respectively is arranged in the refrigerating chamber; and the refrigerator is provided with an air blowing splitter configured to distribute a cooling air flow from a cold source to the plurality of item storage compartments. The partition refrigeration control method comprises: determining that the refrigerating chamber enters a refrigeration state; acquiring the temperatures, sensed by the infrared sensor, of the items stored in the plurality of item storage compartments; comparing the temperature of the item stored in each item storage compartment with a corresponding preset area refrigeration start temperature threshold of each item storage compartment; setting a refrigeration state identifier corresponding to the item storage compartment in which the temperature of the item is higher than the corresponding area refrigeration start temperature threshold as start; and driving the air blowing splitter to operate in a state of providing the cooling air flow to the item storage compartment whose refrigeration state identifier is start.

Optionally, the refrigerating chamber is further provided with a refrigerating environment temperature sensor for sensing an average environment temperature in the refrigerating chamber. In the above partition refrigeration control method, determining that the refrigerating chamber enters the refrigeration state further comprises: acquiring the average environment temperature in the refrigerating chamber; judging whether the average environment temperature in the refrigerating chamber is higher than or equal to a preset overall refrigeration start temperature threshold; and if yes, opening a refrigerating air gate arranged between the cold source and the air blowing splitter to enable the refrigerating chamber to enter the refrigeration state.

Optionally, whether the refrigerating air gate is already in an open state or not is judged when the average environment temperature in the refrigerating chamber is less than the preset overall refrigeration start temperature threshold; if yes, whether the average environment temperature in the refrigerating chamber and/or the temperature of the item in each item storage compartment meet(s) a preset refrigeration stop condition of the refrigerating chamber or not is judged; and if the preset refrigeration stop condition of the refrigerating chamber is met, the refrigerating air gate is closed.

Optionally, the above refrigeration stop condition of the refrigerating chamber comprises: the temperature of the item stored in each item storage compartment being less than a corresponding preset area refrigeration stop temperature threshold of each item storage compartment, wherein the area refrigeration stop temperature threshold of each item storage compartment is less than the corresponding area refrigeration start temperature threshold; or the average environment temperature in the refrigerating chamber being less than a preset overall refrigeration stop temperature threshold.

Optionally, the refrigeration stop condition of the refrigerating chamber comprises: the temperature of the item stored in each item storage compartment being less than a corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

Optionally, after the step of comparing the temperature of the item stored in each item storage compartment with the preset area refrigeration start temperature threshold of each item storage compartment, the method further comprises: comparing the temperature of the item stored in each item storage compartment with the corresponding preset area refrigeration stop temperature threshold of each item storage compartment, wherein the area refrigeration stop temperature threshold of each item storage compartment is smaller than the area refrigeration start temperature threshold thereof; and setting the refrigeration state identifier corresponding to the item storage compartment in which the temperature of the item is less than the corresponding area refrigeration stop temperature threshold as stop.

Optionally, before the step of determining that the refrigerating chamber enters the refrigeration state, the method further comprises: acquiring a powering-on and starting signal of the refrigerator; and initializing a refrigeration system of the refrigerator, the refrigeration system comprising: a compressor, the refrigerating air gate, a fan and the air blowing splitter.

Optionally, the step of initializing the refrigeration system of the refrigerator comprises: powering off the compressor and the fan, closing the refrigerating air gate, and driving the air blowing splitter to operate to an initial position.

Optionally, the refrigerator further comprises a freezing chamber. After the step of initializing the refrigeration system of the refrigerator, the method further comprises: judging whether or not to perform refrigeration on the freezing chamber according to an acquired temperature of the same, so as to adjust a start/stop state of the compressor, the fan and the refrigerating air gate; and after the completion of the refrigeration judgment of the freezing chamber, starting the step of determining that the refrigerating chamber enters the refrigeration state.

According to another aspect of the present invention, there is also provided a partition refrigeration control device for a refrigerating chamber of a refrigerator. The refrigerating chamber is divided into a plurality of item storage compartments; an infrared sensor for sensing temperatures of items stored in the item storage compartments respectively is arranged in the refrigerating chamber; and the refrigerator is provided with an air blowing splitter configured to distribute a cooling air flow from a cold source to the plurality of item storage compartments. The partition refrigeration control device comprises a state determination module configured to determine that the refrigerating chamber enters a refrigeration state; a first temperature acquisition module configured to acquire the temperatures, sensed by the infrared sensor, of the items stored in the plurality of item storage compartments; a first comparison module configured to compare the temperature of the item stored in each item storage compartment with a corresponding preset area refrigeration start temperature threshold of each item storage compartment; an identifier setting module configured to set a refrigeration state identifier corresponding to the item storage compartment in which the temperature of the item is higher than the corresponding area refrigeration start temperature threshold as start; and a driving module configured to drive the air blowing splitter to operate in a state of providing the cooling air flow to the item storage compartment whose refrigeration state identifier is start.

Optionally, the refrigerating chamber is further provided with a refrigerating environment temperature sensor for sensing an average environment temperature in the refrigerating chamber. The partition refrigeration control device further comprises: a second temperature acquisition module configured to acquire the average environment temperature in the refrigerating chamber; an environment temperature judgment module configured to judge whether the average environment temperature in the refrigerating chamber is higher than or equal to a preset overall refrigeration start temperature threshold or not; and an air gate control module configured to open a refrigerating air gate arranged between the cold source and the air blowing splitter to enable the refrigerating chamber to enter the refrigeration state if a judgment result of the environment temperature judgment module is YES.

Optionally, the air gate control module is further configured to: judge whether the refrigerating air gate is already in an open state or not when the average environment temperature in the refrigerating chamber is less than the preset overall refrigeration start temperature threshold; if yes, judge whether the average environment temperature in the refrigerating chamber and/or the temperature of the item in each item storage compartment meet(s) a preset refrigeration stop condition of the refrigerating chamber or not; and if the preset refrigeration stop condition of the refrigerating chamber is met, close the refrigerating air gate.

Optionally, the refrigeration stop condition of the refrigerating chamber comprises: the temperature of the item stored in each item storage compartment being less than a corresponding preset area refrigeration stop temperature threshold of each item storage compartment, wherein the area refrigeration stop temperature threshold of each item storage compartment is less than the corresponding area refrigeration start temperature threshold; or the average environment temperature in the refrigerating chamber being less than a preset overall refrigeration stop temperature threshold.

Optionally, the refrigeration stop condition of the refrigerating chamber comprises: the temperature of the item stored in each item storage compartment being less than the corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

Optionally, the above partition refrigeration control device further comprises a second comparison module configured to compare the temperature of the item stored in each item storage compartment with a corresponding preset area refrigeration stop temperature threshold of each item storage compartment, wherein the area refrigeration stop temperature threshold of each item storage compartment is smaller than the area refrigeration start temperature threshold thereof; and the identifier setting module is further configured to set the refrigeration state identifier corresponding to the item storage compartment in which the temperature of the item is less than the corresponding area refrigeration stop temperature threshold as stop.

Optionally, the above partition refrigeration control device further comprises an initialization module configured to acquire a powering-on and starting signal of the refrigerator, and initialize a refrigeration system of the refrigerator, the refrigeration system comprising: a compressor, the refrigerating air gate, a fan and the air blowing splitter.

Optionally, the initialization module is further configured to power off the compressor and the fan, close the refrigerating air gate, and drive the air blowing splitter to operate to an initial position.

Optionally, the refrigerator further comprises a freezing chamber. The partition refrigeration control device further comprises a third temperature acquisition module configured to: acquire a temperature of the freezing chamber, and judge whether or not to perform refrigeration on the freezing chamber according to the acquired temperature of the same so as to adjust a start/stop state of the compressor, the fan and the refrigerating air gate; and the state determination module is further configured to start the step of determining that the refrigerating chamber enters the refrigeration state is started after the completion of the refrigeration judgment of the freezing chamber.

The partition refrigeration control method and device for the refrigerating chamber of the refrigerator, provided by the present invention are suitable for a case where the refrigerating chamber of the refrigerator is divided into the plurality of item storage compartments. After the refrigerating chamber enters the refrigeration state, the infrared sensor is adopted to sense the temperatures of the items stored in the plurality of item storage compartments; the position and the temperature of a heat source in the refrigerator are accurately determined by receiving infrared radiation energy released from the items placed in the refrigerator; and the sensed temperatures of the items stored in the refrigerator are compared with the preset area refrigeration start temperature thresholds thereof, and a refrigeration state of each item storage compartment is determined in accordance with the comparison results. As the air blowing splitter distributes the cooling air flow to respective item storage compartments in accordance with the refrigeration states of the item storage compartments, the control is more precise. Therefore, refrigeration control according to a condition of the item stored in the corresponding item storage compartment is ensured, and electric energy waste caused by refrigeration of the whole refrigerating chamber is avoided.

Further, the partition refrigeration control method and device for the refrigerating chamber of the refrigerator, provided by the present invention, may quickly cool an item with a relatively higher temperature, and reduce the influence of the item with the relatively higher temperature on other items already stored in the refrigerator, so that the storage effect of the refrigerating chamber of the refrigerator is improved, and nutrient loss of food is reduced.

Furthermore, in the partition refrigeration control method and device for the refrigerating chamber of the refrigerator provided by the present invention, a refrigeration mode of the refrigerating chamber is correspondingly adjusted by comprehensively judging the entire environment temperature in the refrigerating chamber and the temperature of the item stored in each item storage compartment, so that the refrigeration control flexibility of the refrigerating chamber is improved, and requirements of different using habits of users are met.

The above and other objects, advantages and features of the present invention will be understood by those skilled in the art more clearly with reference to the detailed description of the embodiments of the present invention below with reference to the accompanying drawings.

BRIEF DESCRIPTION OF THE DRAWINGS

The followings will describe some specific embodiments of the present invention in detail in an exemplary rather than restrictive manner with reference to the accompanying drawings. The same reference signs in the drawings represent the same or similar components or parts. Those skilled in the art shall understand that these drawings are only schematic ones of the present invention, and may not be necessarily drawn according to the scales. In the drawings.

DETAILED DESCRIPTION OF THE EMBODIMENTS

Figure 1:
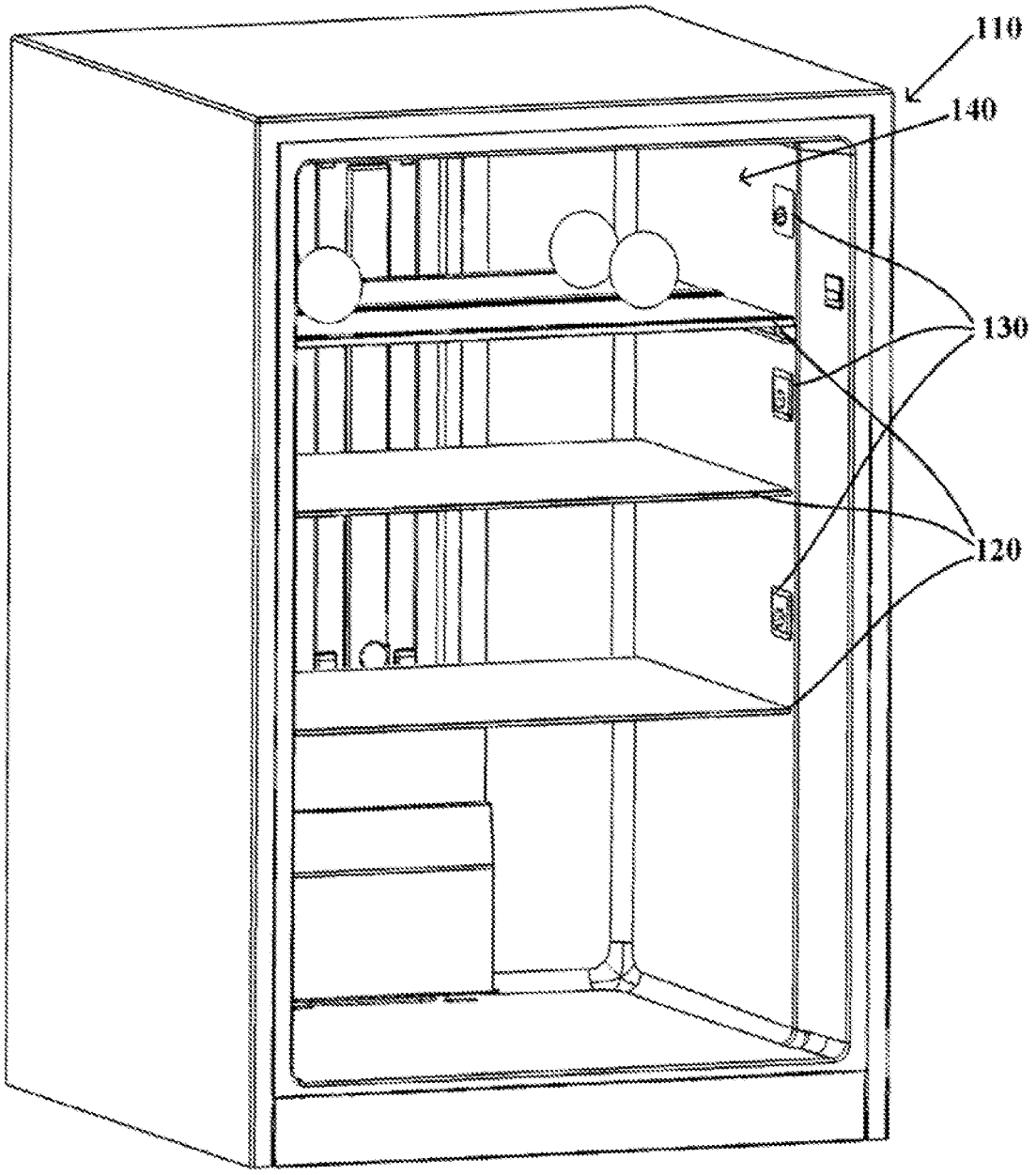
FIG. 1 is a schematically structural view of a refrigerator suitable for a partition refrigeration control device for a refrigerating chamber of the refrigerator according to an embodiment of the present invention.

FIG. 1 is a schematically structural view of a refrigerator suitable for a partition refrigeration control device for a refrigerating chamber of the refrigerator according to an embodiment of the present invention. In order to show an internal structure of the refrigerator, a gate body is not shown. The refrigerator may generally comprise a refrigerator body 110, a shelf assembly 120 and an infrared sensor 130.

The refrigerator body 110 is formed by a top wall, a bottom wall, a rear wall, a left side wall and a right side wall in a surrounding manner. The gate body (not shown) is arranged in the front of the refrigerator body 110, and is connected to the side walls through a pivotal structure. A refrigerating chamber is defined in the refrigerator body 110.

Figure 2:
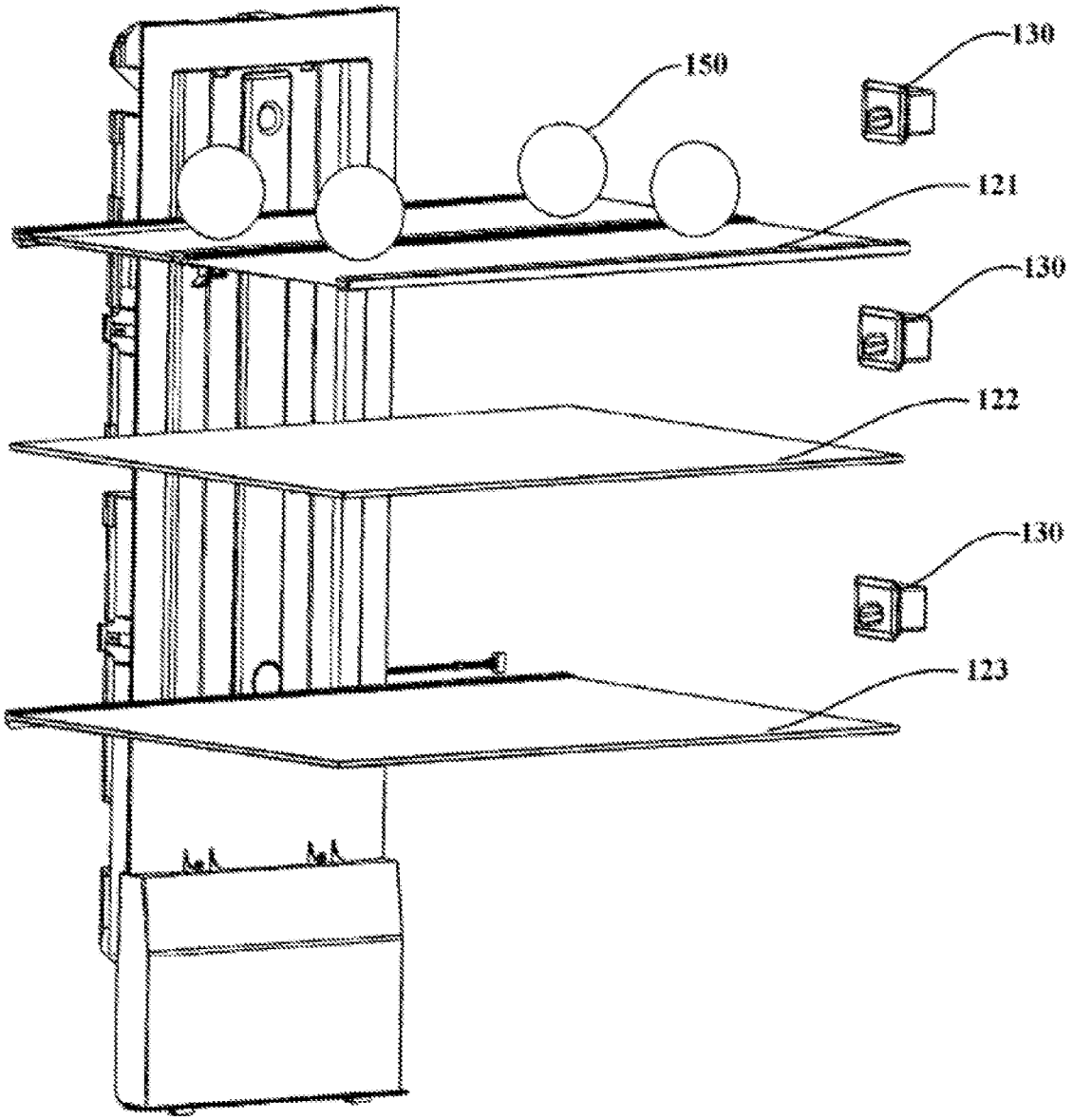
FIG. 2 is a schematically structural view of internal components of a refrigerating chamber of a refrigerator suitable for a partition refrigeration control device for the refrigerating chamber of the refrigerator according to an embodiment of the present invention.

FIG. 2 is a schematically structural view of internal components of a refrigerating chamber of a refrigerator suitable for a partition refrigeration control device for the refrigerating chamber of the refrigerator according to an embodiment of the present invention. The refrigerating chamber is divided into a plurality of item storage compartments 140 through the shelf assembly 120. A preferable structure is that the shelf assembly 120 comprises at least one horizontally arranged partition to divide the refrigerating chamber into the plurality of item storage compartments 140 in the vertical direction. In FIG. 2, the shelf assembly 120 comprises a first partition plate 121, a second partition plate 122 and a third partition plate 133, wherein a first item storage compartment is formed above the first partition plate 121, a second item storage compartment is formed between the first partition plate 121 and the second partition plate 122, and a third item storage compartment is formed between the second partition plate 122 and the third partition plate 123. In other embodiments of the present invention, the number of the partition plates in the shelf assembly 120 and the number of the item storage compartments 140 may be preset according to the volume of the refrigerator and use requirements.

In the embodiment shown in FIG. 2, there are multiple infrared sensors 130. Each infrared sensor 130 is arranged on the inner wall of the refrigerator body 110 of the corresponding item storage compartment 140, and is configured to sense infrared radiation energy emitted by an item 150 placed in the item storage compartment 140 to determine a surface temperature of the item 150. In the embodiment shown in FIG. 2, a first infrared sensor is arranged in the first item storage compartment; a second infrared sensor is arranged in the second item storage compartment; and a third infrared sensor is arranged in the third item storage compartment. The number of the infrared sensors is set in accordance with the number of the item storage compartments 140.

Figure 3:
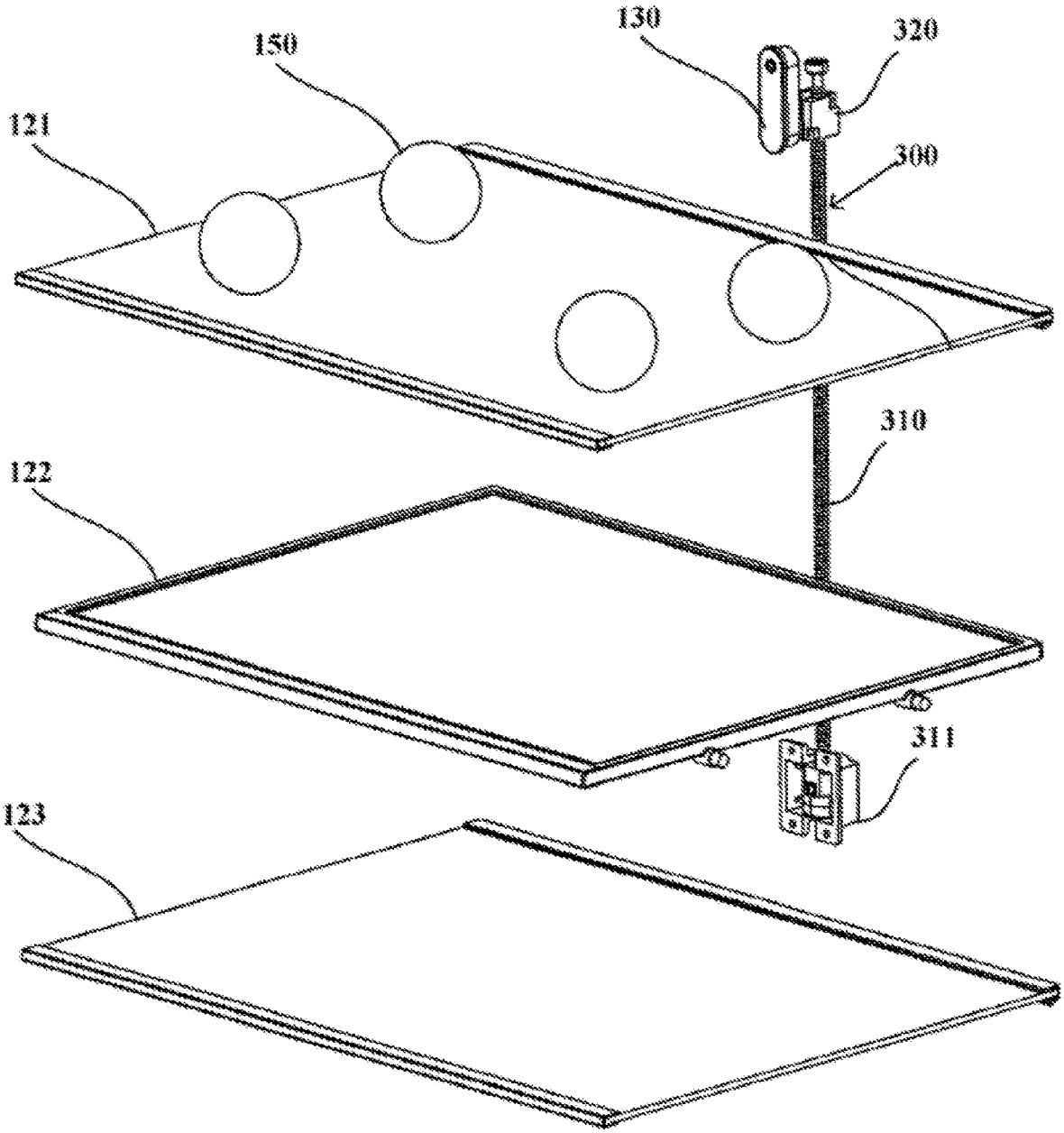
FIG. 3 is a schematically structural view of internal components of a refrigerating chamber of a refrigerator suitable for a partition refrigeration control device for the refrigerating chamber of the refrigerator according to another embodiment of the present invention.

FIG. 3 is a schematically structural view of internal components of a refrigerating chamber of a refrigerator suitable for a partition refrigeration control device for the refrigerating chamber of the refrigerator according to another embodiment of the present invention. In this refrigerator, in order to reduce hardware cost of the infrared sensor 130, a helical driving assembly 300 is adopted to drive the infrared sensor 130 to sense temperatures of items in the plurality of item storage compartments.

The helical driving assembly 300 is vertically arranged inside the refrigerating chamber, and comprises a screw rod 310, a nut 320 and a limiting component. The screw rod 310 is vertically arranged and penetrates through the plurality of item storage compartments 140. The nut 320 is threadedly meshed with the screw rod 310. The limiting component is configured to limit a rotation angle of the nut 320 relative to the refrigerating chamber, so that the screw rod 310 can drive the nut 320 to move vertically when rotating around its axis as the center. The screw rod 310 may be driven by a driving motor 311 to rotate around its axis as the center. As the limiting component limits the angle of the nut 320, the nut 320 can move vertically during the rotation of the screw rod 310. In the refrigerator provided by the present embodiment, the screw rod 310 and the nut 320 may adopt a sliding helical driving mode or a rolling helical driving mode to change a rotational movement to a linear movement so as to drive the nut 320 to move vertically.

The infrared sensor 130 is fixedly arranged on the nut 320, faces the refrigerating chamber, and is configured to sense infrared radiation energy emitted by the items 150 placed in the plurality of item storage compartments 140 to determine the surface temperature of each item 150. The above-mentioned helical driving assembly 300 and the infrared sensor 130 may be arranged on any side wall or a rear wall of the refrigerator body 110, and preferably, are arranged on the rear wall of the refrigerator body.

A sensing position is preset on the helical driving assembly 300 at a predetermined height within each item storage compartment 140, so that the infrared sensor 130 can sense the temperature of the item storage compartment after moving to the sensing position. The sensing positions may be preset according to the internal space of the refrigerator. Through a locking mechanism and control of the driving motor 311, the screw rod 310 is driven to stop rotating when the infrared sensor 130 is moved to the predetermined height of each item storage compartment. After finishing sensing the temperature of the item storage compartment, the infrared sensor 130 is driven to move upwards or downwards to the sensing position of the adjacent item storage compartment.

Figure 4:
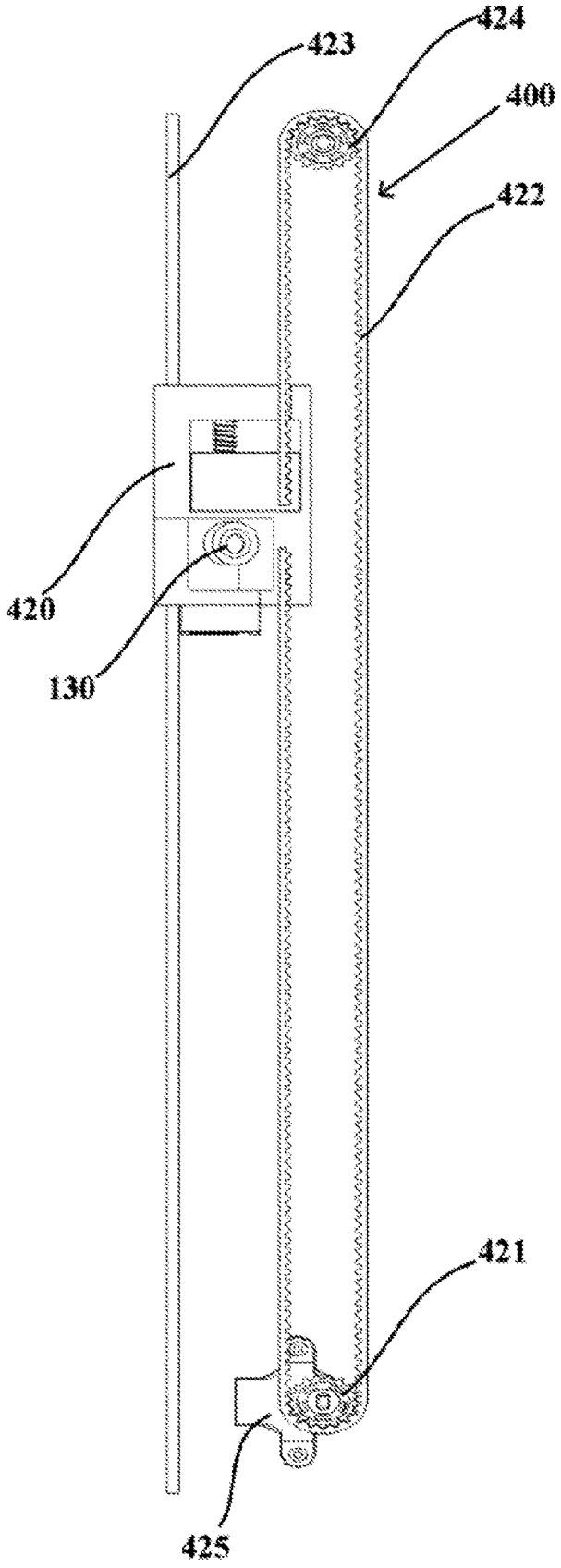
FIG. 4 is a schematically structural view of a driving mechanism for an infrared sensor in a refrigerator suitable for a partition refrigeration control device for a refrigerating chamber of the refrigerator according to another embodiment of the present invention.

FIG. 4 is a schematically structural view of a driving mechanism for an infrared sensor in a refrigerator suitable for a partition refrigeration control device for a refrigerating chamber of a refrigerator according to another embodiment of the present invention. In the refrigerator shown in FIG. 4, the infrared sensor 130 is moved by a synchronous belt driving assembly 400.

The synchronous belt driving assembly 400 is arranged in the refrigerating chamber; a synchronous belt 422 of the synchronous belt driving assembly is in a vertical plane, and comprises a vertical section which is vertically arranged and penetrates through the plurality of item storage compartments 140. The synchronous belt driving assembly is realized by a circular belt whose inner circumferential surface is provided with uniformly-spaced teeth and gears correspondingly matched with the same, and combines advantages of belt driving, chain driving and gear driving. When in rotation, power is transmitted by the belt teeth and gear tooth troughs meshed with the same.

A sliding block 420 is fixedly arranged on the vertical section of the above synchronous belt 422 to be moved vertically under the driving of the synchronous belt driving assembly 400; the infrared sensor 130 is fixedly arranged on the sliding block 420, faces the refrigerating chamber, and is configured to sense infrared radiation energy emitted by the items 150 placed in the plurality of item storage compartments 140 to determine the surface temperature of each item 150.

The synchronous belt driving assembly 400 may be arranged on any side wall or the rear wall of the refrigerator body 110, and preferably, is arranged on the side wall. The infrared sensor 130 senses infrared rays through a sensing device cover plate made of an infrared ray transmission material. The surface, facing the refrigerating chamber, of the sensing device cover plate may be flush with the inner surface of each side wall to improve the appearance of the refrigerating chamber of the refrigerator and the neatness of the item storage compartments 140.

A drive gear 421 in the synchronous belt driving assembly 400 is arranged at the bottom end of the synchronous belt driving assembly 400, and is rotated under the driving of the driving motor 425 to drive the synchronous belt 422. A driven gear 424 in the synchronous belt driving assembly 400 is arranged at the top end of the same. The inner side of the synchronous belt 422 winds the outer edges of both the drive gear 421 and the driven gear 424; and the teeth of the synchronous belt 422 are meshed with the tooth troughs of the drive gear 421 and of the driven gear 424, so that the driven gear 424 is moved under the driving of the drive gear 421. The drive gear 421 and the driven gear 424 may tension the synchronous belt 422 to convert a rotational movement to a linear movement of the sliding block 420. In an alternative embodiment, the drive gear 421 and the driven gear 424 have the same gear diameter and tooth pitch, and a center line of the drive and driven gears is vertical.

In addition, the synchronous belt driving assembly 400 may also be provided with a guide bar 423 parallel to the vertical section; and the sliding block 420 is provided with a through hole through which the guide bar 323 penetrates, so that a moving direction of the infrared sensor 130 is limited through the guide bar 423. A sensing position on the guide bar 423 is preset at a predetermined height within each item storage compartment 140, so that the infrared sensor 130 can sense the temperature of the item storage compartment after moving to the sensing position.

The sensing position on the synchronous belt driving assembly 400 is preset at the predetermined height within each item storage compartment 140, so that the infrared sensor 130 can sense the temperature of the item 150 in the item storage compartment 140 after moving to the sensing position. The sensing positions may be preset according to the internal space of the refrigerator. Through the control of the driving motor 425 and a locking mechanism, the sensing position of each item storage space is determined, and the drive gear 421 stops rotating when the infrared sensor 130 is moved to the sensing position. After finishing sensing the temperature of the item storage compartment 140, the infrared sensor 130 is driven to move upwards or downwards to the sensing position of the adjacent item storage compartment 140.

The infrared sensor 130 shown in any of FIGS. 2-4 does not emit infrared rays, but passively receives infrared rays emitted by the items 150 in the sensed spaces and background infrared rays, directly senses a temperature change range and the temperature of each item in each refrigerator, and converts a temperature signal to a corresponding electrical signal. Compared with an infrared sensing device in the prior art, the infrared sensor 130 provided by the present invention may detect the infrared rays in the whole item storage compartments 140, rather than merely detecting the position of a heat source point. In addition, the infrared sensor 130 may be an infrared receiver having a rectangular field of view that may be configured to enable a projection of an infrared receiving range of the infrared receiver on a horizontal plane to cover the partition plates, so that the infrared sensor 130 can sense infrared radiation energy released by the items placed on the partition plates. The infrared receiver may limit the above rectangular view by arranging an infrared guide component; and the detection accuracy may be improved by limiting a detection direction to accurately detect the item storage compartments. The difference between the different embodiments described above only lies in the manners of sensing the temperatures of the items in the item storage compartments by the infrared sensor 130. Theses manners relate to the followings: the plurality of infrared sensors 130 is adopted to sense the temperatures respectively; and one infrared sensor 130 is driven through the helical driving mode or the synchronous belt driving mode to sense the temperatures of the items in the item storage compartments.

In addition, the refrigerator in the present embodiment may be also provided with a refrigerating environment temperature sensor (not shown) for sensing an average environment temperature in the refrigerating chamber. The partition refrigeration control device for the refrigerating chamber of the refrigerator may be implemented by a temperature sensor such as a thermistor. The refrigeration of the refrigerator in the present embodiment may be controlled according to the temperatures of the items determined by the infrared sensor 130 and the environment temperature in the refrigerating chamber.

Figure 5:
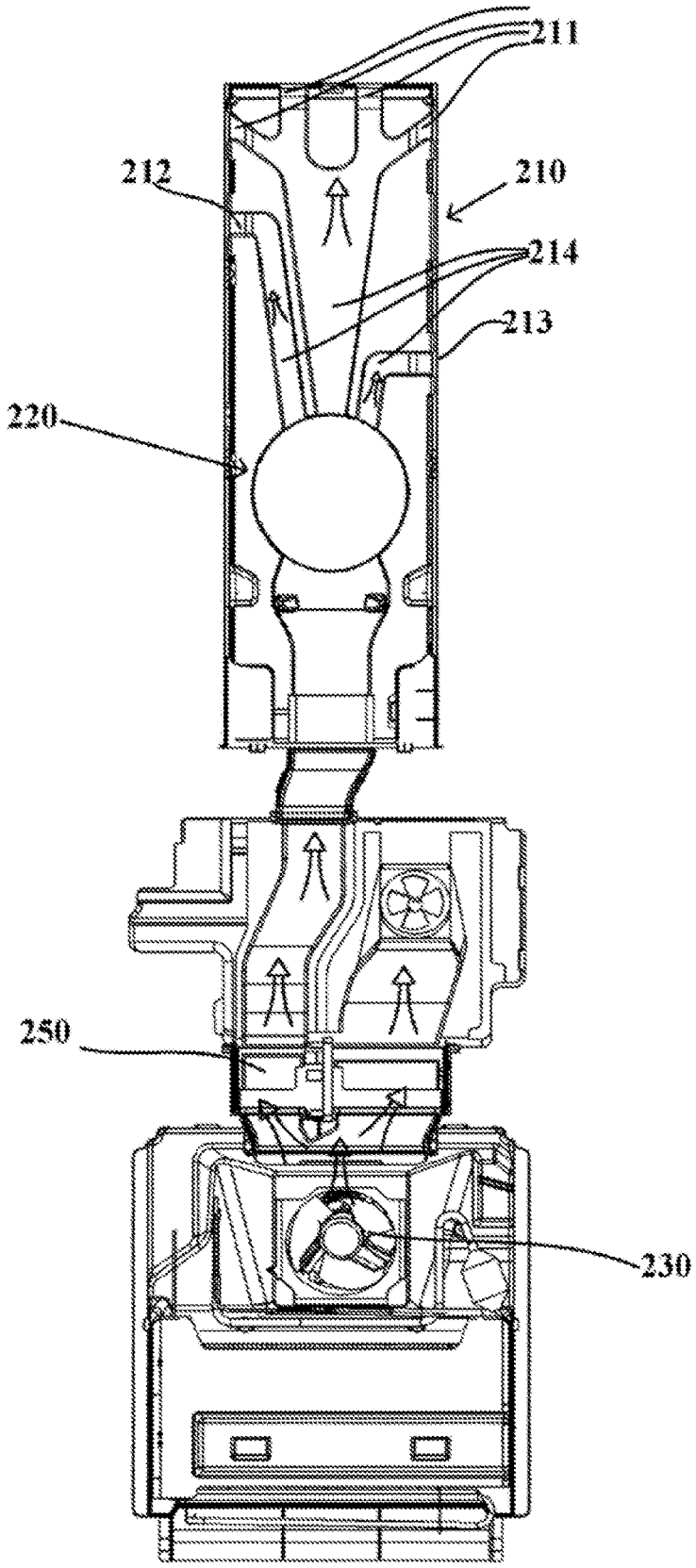
FIG. 5 is a schematic view of a refrigeration system of a refrigerator suitable for a partition refrigeration control device for a refrigerating chamber of the refrigerator according to an embodiment of the present invention.
Figure 6:
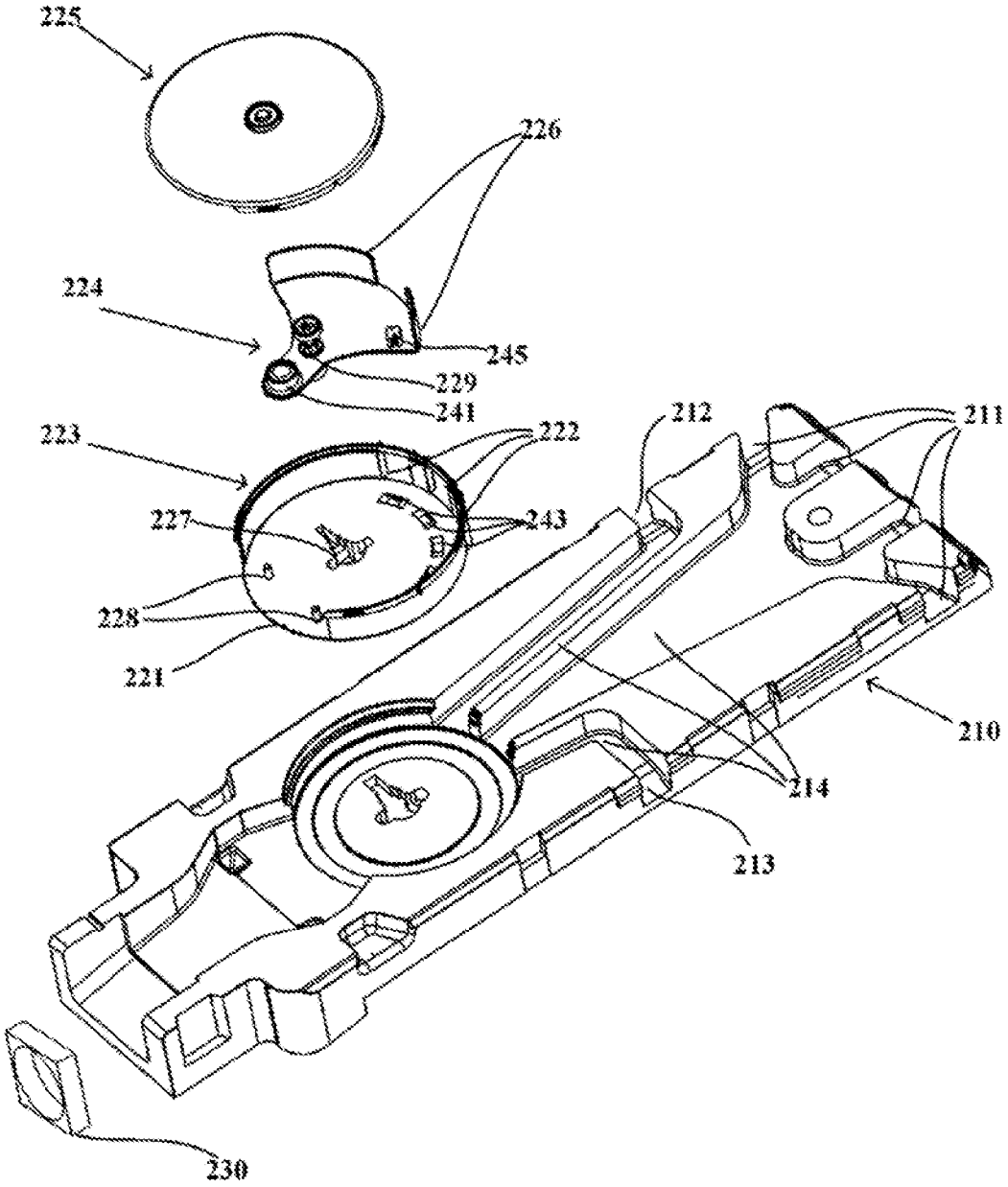
FIG. 6 is a schematic view of an air duct assembly in a refrigeration system of a refrigerator suitable for a partition refrigeration control device for a refrigerating chamber of the refrigerator according to an embodiment of the present invention.

The refrigerator suitable for the partition refrigeration control device for the refrigerating chamber of the refrigerator in the present embodiment may be an air-cooled refrigerator. FIG. 5 is a schematic view of a refrigeration system of a refrigerator suitable for a partition refrigeration control device for a refrigerating chamber of the refrigerator according to an embodiment of the present invention. FIG. 6 is a schematic view of an air duct assembly in a refrigeration system of a refrigerator suitable for a partition refrigeration control device for a refrigerating chamber of the refrigerator according to an embodiment of the present invention. The refrigeration system comprises the air duct assembly, a compressor, a refrigerating air gate 250, a fan 230, and the like. The refrigerator can use an evaporator, the compressor, a condenser, a throttle component and other components to form a refrigeration circulation loop through a refrigerant pipe; and the evaporator releases cold energy after the compressor is started.

The evaporator may be arranged in an evaporator chamber. Air cooled by the evaporator is conveyed to a storage chamber via the fan 230. For example, the interior of the storage chamber of the refrigerator can be separated into a variable temperature chamber, a refrigerating chamber and a freezing chamber, wherein the uppermost layer of the storage chamber is the refrigerating chamber, the variable temperature chamber is arranged below the refrigerating chamber, the freezing chamber is arranged below the variable temperature chamber, and the evaporator chamber may be arranged in back of the freezing chamber. The fan 230 is arranged at an exit above the evaporator chamber. Correspondingly, an air supply path for supplying the air cooled by the evaporator comprises a variable temperature air supply path configured to supply air to the variable temperature chamber and connected to the same, a freezing air supply path for supplying air to the freezing chamber and connected to the same, and a refrigerating air supply path for supplying air to the refrigerating chamber and connected to the same.

In the present embodiment, the air duct assembly is an air path system for blowing air to the refrigerating chamber, and comprises an air duct bottom plate 210, an air blowing splitter 220 and the fan 230. A plurality of air paths 214 defined on the air duct bottom plate 210 leads to the plurality of item storages compartments 140, respectively. For example, in the embodiment shown in FIG. 1, there are provided with a first air supply port 211 leading to the first item storage compartment, a second air supply port 212 leading to the second item storage compartment, and a third air supply port 213 leading to the third item storage compartment. The air blowing splitter 220 is arranged in the refrigerating air supply path which is formed in the back of the refrigerating chamber, and comprises an air inlet 221 connected to a cold source (for example, the evaporator chamber) and a plurality of distribution ports 222 connected to the plurality of air paths 214. The distribution ports 222 are connected to the different air paths 214, respectively. The air blowing splitter 220 may controllably distribute cold air from the cold source and generated by the fan 230 to the different distribution ports 222 via the air inlet 221, so that the cold air can enter the different item storage compartments 140 through the different air paths 214.

The split air blowing splitter 220 can centrally distribute the refrigeration air flow from the cold source, instead of arranging the different air paths for the different item storage compartments 140, respectively, thereby improving the refrigeration efficiency. The air blowing splitter 220 may comprise a casing 223, an adjustment part 224 and a cover plate 225. The air inlet 221 and the distribution ports 222 are formed in the casing 223; and the cover plate 225 is assembled with the casing 223 to form a split air blowing chamber in which the adjustment part 224 is arranged. The adjustment part 224 is provided with at least one shielding part 226 which is movably arranged in the casing 223 and configured to shield the plurality of distribution ports 222 to adjust an air outlet area of each distribution port 222.

Air from the fan 230 is distributed to the different item storage compartments 140 through the distribution of the adjustment part 224. In the embodiment shown in FIG. 6, the air blowing splitter 220 can achieve up to seven air blowing states. For example, the distribution port 222 corresponding to the first air supply port 211 is opened separately; the distribution port 222 corresponding to the second air supply port 212 is opened separately; the distribution port 222 corresponding to the third air supply port 213 is opened separately; the distribution ports 222 corresponding to the first and second air supply ports 211 and 212 are opened simultaneously; the distribution ports 222 corresponding to the first and third air supply ports 211 and 213 are opened simultaneously; the distribution ports 222 corresponding to the second and third air supply ports 212 and 213 are opened simultaneously; and the distribution ports 222 corresponding to the first, second and third air supply ports 211, 212 and 213 are opened simultaneously. In the present embodiment, if the refrigerator is provided with two item storage compartments through a partition, the air blowing splitter 220 may be provided with two distribution ports, and there may be three air blowing states. When air is blown in a split manner, the adjustment part 224 is rotated with a rotation angle determined according to a required air volume, and guide ports formed between the shielding parts 226 are aligned to the corresponding distribution ports 222.

The casing 223 is provided with a motor 227, two stopper posts 228, and a positioning holder recess 243 in the split air blowing chamber. The action of the stopper posts 228 is that during operating of the motor 227, the movement of the adjustment part 224 is more accurate. In addition, when powering on or after powering on for a period of time very time, the adjustment part 224 moves to any starting stopper post 228 and then rotates to a designated rotational position by taking the stopper post as the starting point. The action of the positioning holder recess 243 is to ensure that the adjustment part 224 is positioned at an angular position where it rotates by 30 degrees every time. The adjustment part 224 is provided with a disk spring 229 (the disk spring 229 may be replaced by a torsion spring), a counterweight 241 and a positioning pin 245. One end of the disk spring 229 is fixed onto the cover plate 225, and the other end thereof is pre-tensioned to apply an opposite force along with the rotation of the adjustment part 224; and a constant biasing force is always applied to the adjustment part 224 to prevent a shaking problem caused by a tooth clearance of a driving mechanism of a direct-current step motor 227. A counterweight portion is formed in the extending direction, opposite to the radial direction of a main body of the adjustment part 224, of a pivotal portion; and the counterweight 241 is arranged at the far end of the counterweight portion to eliminate a bias torque. The positioning pin 245 is fixed on the adjustment part 224 and can move vertically (through a compression spring) on the same. The casing 223 is provided with the positioning holder recess 243 cooperating therewith.

It should be noted that in the present embodiment, the refrigerator having three item storage compartments 140 is taken as an example to describe. In actual use, the numbers of the infrared sensor 130, the air path 214, the distribution port 222, and the air supply port may be set according to the specific use requirements to meet the requirements of different refrigerators. For example, according to the above description, it is easy to obtain an air blowing system of a refrigerating chamber having two refrigerating item storage compartments.

Figure 7:
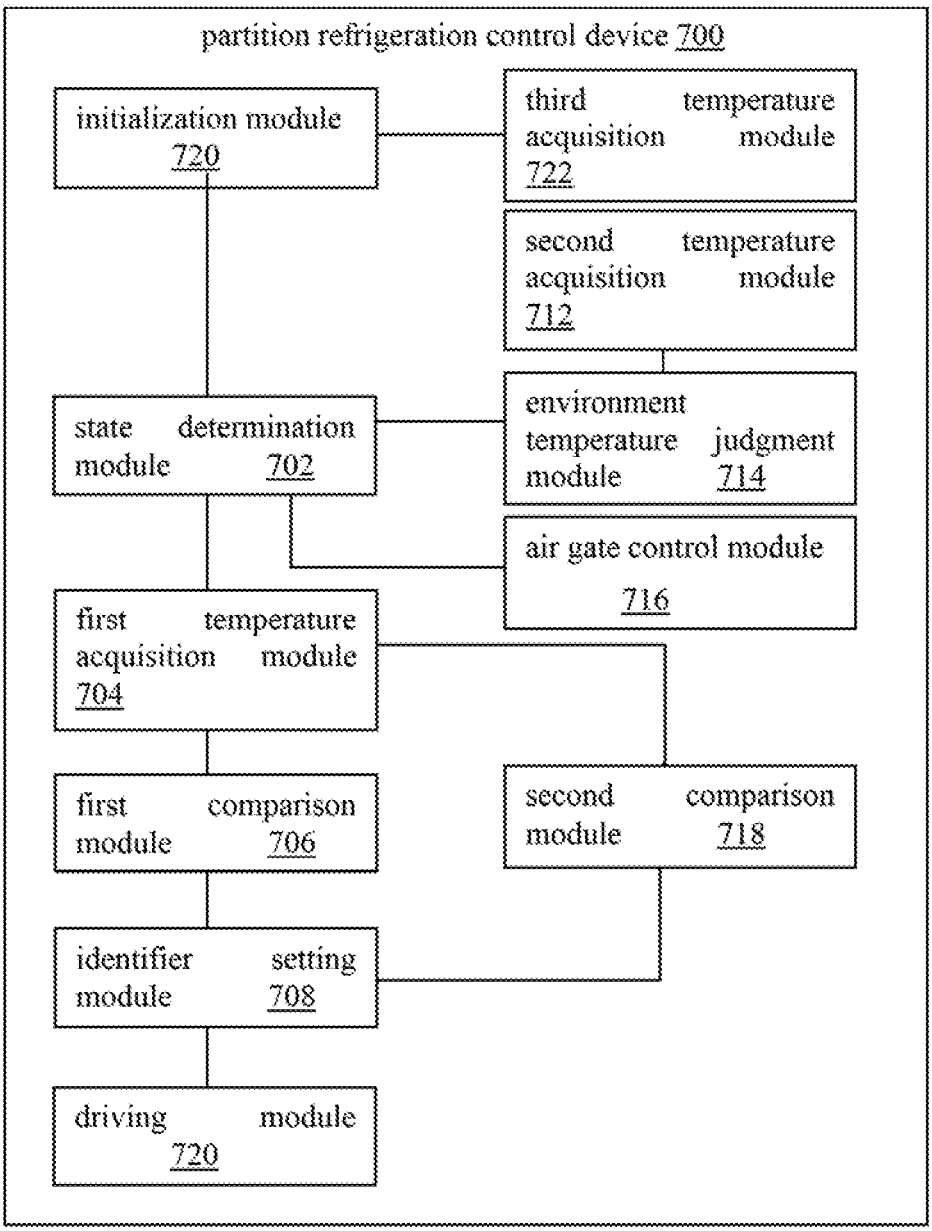
FIG. 7 is a schematic block diagram of a partition refrigeration control device for a refrigerating chamber of a refrigerator according to an embodiment of the present invention.

A partition refrigeration control device 700 provided by a refrigerator circuitry for a refrigerating chamber of a refrigerator, provided by the embodiments of the present invention is configured to perform partition control on the refrigerating chamber of the above refrigerator. FIG. 7 is a schematic block diagram of a partition refrigeration control device for a refrigerating chamber of a refrigerator according to an embodiment of the present invention. The partition refrigeration control device 700 for the refrigerating chamber of the refrigerator generally comprises: a state determination module 702, a first temperature acquisition module 704, a first comparison module 706, an identifier setting module 708 and a driving module 710. In addition, in order to improve the technical effect of the partition refrigeration control device 700 for the refrigerating chamber of the refrigerator in the present embodiment, a second temperature acquisition module 712, an environment temperature judgment module 714, an air gate control module 716, a second comparison module 718, an initialization module 720 and a third temperature acquisition module 722 are further arranged, and can be configured flexibly according to the actual configuration conditions of the refrigerator and use requirements. In some alternative embodiments, some or all of the above modules may be configured.

The state determination module 702 may be configured to determine that the refrigerating chamber enters a refrigeration state. The refrigeration state may be started after an average environment temperature, sensed by the refrigerating environment temperature sensor, in the refrigerating chamber is higher than or equal to a preset overall refrigeration start temperature threshold. An alternative step of determining by the state determination module 702 that the refrigerating chamber enters the refrigeration state comprises: acquiring by the second temperature acquisition module 712 the average environment temperature in the refrigerating chamber through the refrigerating environment temperature sensor; judging by the environment temperature judgment module 714 whether the average environment temperature in the refrigerating chamber is higher than or equal to the preset overall refrigeration start temperature threshold or not; and opening by the air gate control module 716 a refrigerating air gate arranged between a cold source and an air blowing splitter to enable the refrigerating chamber to enter the refrigeration state if a judgment result of the environment temperature judgment module 714 is YES.

The first temperature acquisition module 704 may acquire the temperatures, sensed by the infrared temperature sensor, of the items stored in the plurality of item storage compartments. The temperatures of the items stored in the plurality of item storage compartments may be detected after one infrared sensor 130 is moved to the sensing position of each item storage compartment, or may be sensed by the plurality of infrared sensors 130 distributed in the plurality of item storage compartment, respectively.

The first comparison module 706 may be configured to compare the temperature of the item stored in each item storage compartment with a corresponding preset area refrigeration start temperature threshold of each item storage compartment. The identifier setting module 708 is configured to set a refrigeration state identifier corresponding to the item storage compartment in which the temperature of the item is higher than the corresponding area refrigeration start temperature threshold as start.

The driving module 710 is configured to drive the air blowing splitter 220 to operate in a state of providing the cooling air flow to the item storage compartment whose refrigeration state identifier is start.

The air gate control module 716 is configured to: judge whether the refrigerating air gate is already in an open state or not when the average environment temperature in the refrigerating chamber is less than the preset overall refrigeration start temperature threshold; if yes, judge whether the average environment temperature in the refrigerating chamber and/or the temperature of the item in each item storage compartment meet(s) a preset refrigeration stop condition of the refrigerating chamber or not; and if the preset refrigeration stop condition of the refrigerating chamber is met, close the refrigerating air gate.

The above refrigeration stop condition of the refrigerating chamber may comprise: the temperature of the item stored in each item storage compartment being less than a corresponding preset area refrigeration stop temperature threshold of each item storage compartment, wherein the area refrigeration stop temperature threshold of each item storage compartment is less than the corresponding area refrigeration start temperature threshold; or the average environment temperature in the refrigerating chamber being less than a preset overall refrigeration stop temperature threshold.

Another alternative refrigeration stop condition of the refrigerating chamber comprises: the temperature of the item stored in each item storage compartment being less than a corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

The second comparison module 718 is configured to compare the temperature of the item stored in each item storage compartment with a corresponding preset area refrigeration stop temperature threshold of each item storage compartment, wherein the area refrigeration stop temperature threshold of each item storage compartment is smaller than the area refrigeration start temperature threshold thereof. Correspondingly, the identifier setting module 708 is further configured to set a refrigeration state identifier corresponding to the item storage compartment in which the temperature of the item is less than the corresponding area refrigeration stop temperature threshold as stop.

The initialization module 720 may be configured to acquire a powering-on and starting signal of the refrigerator, and initialize a refrigeration system of the refrigerator. The refrigeration system comprises: a compressor, the refrigerating air gate, a fan and the air blowing splitter. In an alternative embodiment, the initialization module 720 may be further configured to power off the compressor and the fan, close the refrigerating air gate, and drive the air blowing splitter to operate to the initial position.

In addition, the third temperature acquisition module 722 in the partition refrigeration control device 700 may be further configured to acquire a temperature of the freezing chamber, and perform refrigeration control on the freezing chamber according to the temperature of the freezing chamber. For example, the third temperature acquisition module performs refrigeration judgment on the freezing chamber according to the temperature of the freezing chamber, and adjusts a start/stop state of the compressor, the fan and the refrigerating air gate according to a judgment result. Correspondingly, the state determination module 702 is configured to start the step of determining that the refrigerating chamber enters the refrigeration state after the refrigeration judgment of the freezing chamber is finished.

Figure 8:
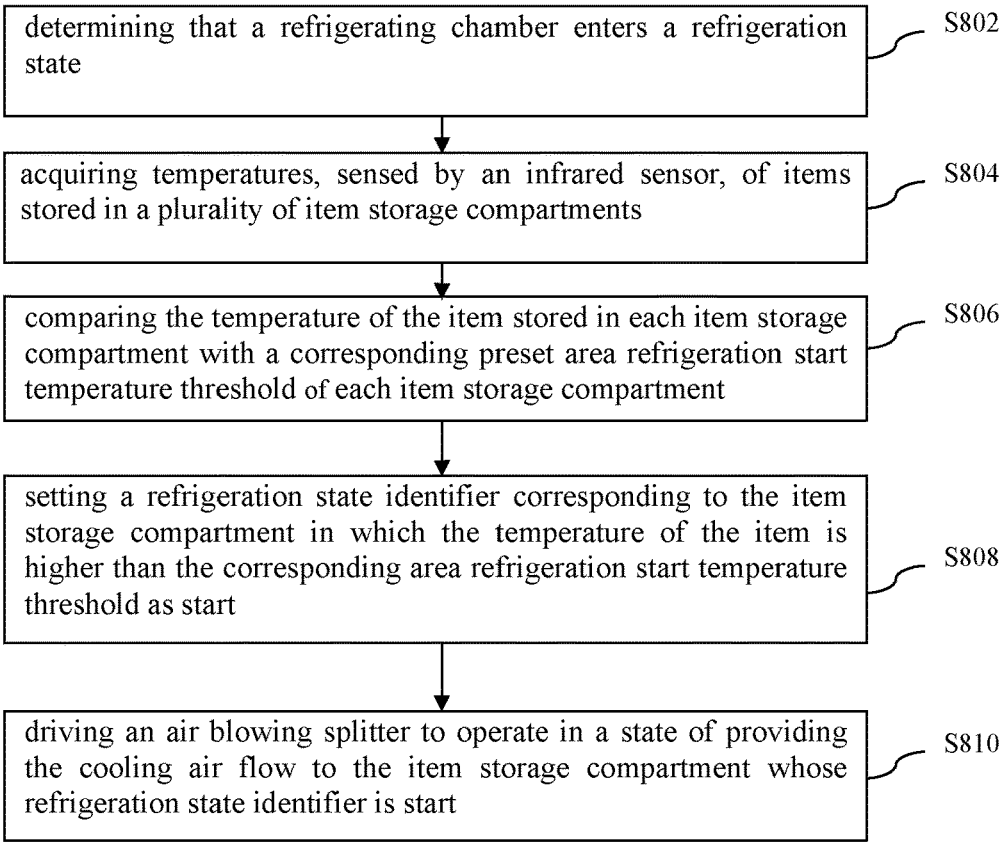
FIG. 8 is a schematic view of a partition refrigeration control method for a refrigerating chamber of a refrigerator according to an embodiment of the present invention.

The embodiments of the present invention further provide a partition refrigeration control method for a refrigerating chamber of a refrigerator. The partition refrigeration control method for the refrigerating chamber of the refrigerator may be executed by the partition refrigeration control device 700 for the refrigerating chamber of the refrigerator provided by any of the above embodiments, so as to realize partition refrigeration of the refrigerating chamber of the refrigerator. FIG. 8 is a schematic view of a partition refrigeration control method for a refrigerating chamber of a refrigerator according to an embodiment of the present invention. The partition refrigeration control method for the refrigerating chamber of the refrigerator comprises:

step S802, determining that the refrigerating chamber enters a refrigeration state;

step S804, acquiring temperatures, sensed by an infrared sensor, of items stored in a plurality of item storage compartments;

step S806, comparing the temperature of the item stored in each item storage compartment with a corresponding preset area refrigeration start temperature threshold of each item storage compartment;

step S808, setting a refrigeration state identifier corresponding to the item storage compartment in which the temperature of the item is higher than the corresponding area refrigeration start temperature threshold as start; and step S810, driving an air blowing splitter to operate in a state of providing a cooling air flow to the item storage compartment whose refrigeration state identifier is start.

In step S802, determining that the refrigerating chamber enters the refrigeration state further comprises: acquiring the average environment temperature in the refrigerating chamber; judging whether the average environment temperature in the refrigerating chamber is higher than or equal to a preset overall refrigeration start temperature threshold; and if yes, opening a refrigerating air gate arranged between a cold source and the air blowing splitter to enable the refrigerating chamber to enter the refrigeration state.

Here, whether the refrigerating air gate is already in an open state or not is judged when the average environment temperature in the refrigerating chamber is less than the preset overall refrigeration start temperature threshold; if yes, whether the average environment temperature in the refrigerating chamber and/or the temperature of the item in each item storage compartment meet(s) a preset refrigeration stop condition of the refrigerating chamber or not is judged; and if the preset refrigeration stop condition of the refrigerating chamber is met, the refrigerating air gate is closed.

The above refrigeration stop condition of the refrigerating chamber may comprise: the temperature of the item stored in each item storage compartment being less than a corresponding preset area refrigeration stop temperature threshold of each item storage compartment, wherein the area refrigeration stop temperature threshold of each item storage compartment is less than the corresponding area refrigeration start temperature threshold; or the average environment temperature in the refrigerating chamber being less than a preset overall refrigeration stop temperature threshold.

Another alternative refrigeration stop condition of the refrigerating chamber comprises: the temperature of the item stored in each item storage compartment being less than a corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

After step S806, the method may further comprise: comparing the temperature of the item stored in each item storage compartment with the corresponding preset area refrigeration stop temperature threshold of each item storage compartment, wherein the area refrigeration stop temperature threshold of each item storage compartment is smaller than the area refrigeration start temperature threshold thereof; and setting the refrigeration state identifier corresponding to the item storage compartment in which the temperature of the item is less than the corresponding area refrigeration stop temperature threshold as stop.

In addition, before step S802, the method further comprises: acquiring a powering-on and starting signal of the refrigerator; and initializing a refrigeration system of the refrigerator, the refrigeration system comprising a compressor, the refrigerating air gate, a fan and the split air blowing splitter. Correspondingly, the above initializing process may comprise: powering off the compressor and the fan, closing the refrigerating air gate, and driving the air blowing splitter to operate to the initial position. In addition, after the initialization, the freezing chamber may be subjected to refrigeration control first; and after the refrigeration control of the freezing chamber is completed, step S802 and the followed steps for partition refrigeration of the refrigerating chamber are executed. An alternative flow for control of the freezing chamber comprises: acquiring a temperature of the freezing chamber, and performing refrigeration control on the freezing chamber according to the temperature of the freezing chamber. For example, refrigeration judgment of the freezing chamber is performed according to the temperature of the freezing chamber, and a start/stop state of the compressor, the fan and the refrigerating air gate is adjusted according to the judgment result. Step S802 is executed after the refrigeration judgment of the freezing chamber is completed.

The partition refrigeration control method for the refrigerating chamber of the refrigerator provided by the present embodiment can control the temperatures of the plurality of item storage compartments of the refrigerating chamber respectively, so that the storage effect of the items in the refrigerating chamber is improved. The partition refrigeration control method and device are introduced below by taking the refrigerating chamber with three item storage compartments as an example.

According to the partial refrigeration control method for the refrigerating chamber of the refrigerator in the present embodiment, the following parameters comprising an area refrigeration start temperature threshold, an area refrigeration stop temperature threshold, an overall refrigeration start temperature threshold, an overall refrigeration stop temperature threshold, a set temperature of the refrigerating chamber, and a set temperature of the freezing chamber can be predetermined according to the features of the refrigerating chamber of the refrigerator and the types of the stored items. Table 1 shows a parameter table set for partition refrigeration of the refrigerating chamber with three item storage compartments.

TABLE 1

| | Value detected by sensor | Set temperature | Start temperature threshold | Stop temperature threshold |
|---|---|---|---|---|
| Freezing chamber | FT | F-set | F-on | F-off |
| Refrigerating chamber environment | RT | R-set | R-on | R-off |
| First item storage compartment | IRT1 | None | IR1-on | IR1-off |
| Second item storage compartment | IRT2 | None | IR2-on | IR2-off |
| Third item storage compartment | IRT3 | None | IR3-on | IR3-off |

It can be seen from Table 1 that a temperature value of the freezing chamber detected by the sensor is FT; the set temperature of the freezing chamber is F-set; the refrigeration start temperature threshold is F-on; and the refrigeration stop temperature threshold is F-off. F-set may be set by a user or may be a default value; F-on and F-off may be determined according to F-set; and generally, they meet the relationship of F-on>F-set>F-off.

For the refrigerating chamber, the average environment temperature, sensed by the refrigerating environment temperature sensor, in the refrigerating chamber is RT; the temperature set for the refrigerating chamber is R-set; the overall refrigeration start temperature threshold is R-on; and the overall refrigeration stop temperature threshold is R-off. R-set may be set by the user or may be a default value; R-on and R-off may be determined according to R-set; and generally, they meet the relationship of R-on>R-set>R-off.

For the first item storage compartment of the refrigerating chamber, the maximum temperature, sensed by the infrared sensor, of an item stored in the first item storage compartment is IRT1; the area refrigeration start temperature threshold of the first item storage compartment is IR1-on; and the area refrigeration stop temperature threshold of the first item storage compartment is IR1-off. The IR1-on and IR1-off may be determined according to R-set and the type of the item stored in the first item storage compartment; and generally, they meet the relationship of IR1-on>IR1-off.

For the second item storage compartment of the refrigerating chamber, the maximum temperature, sensed by the infrared sensor, of an item stored in the second item storage compartment is IRT2; the area refrigeration start temperature threshold of the second item storage compartment is IR2-on; and the area refrigeration stop temperature threshold of the second item storage compartment is IR2-off. IR2-on and IR2-off may be determined according to R-set and the type of the item stored in the second item storage compartment; and generally, they meet the relationship of IR2-on>IR2-off.

For the third item storage compartment of the refrigerating chamber, the maximum temperature, sensed by the infrared sensor, of an item stored in the third item storage compartment is IRT3; the area refrigeration start temperature threshold of the third item storage compartment is IR3-on; and the area refrigeration stop temperature threshold of the third item storage compartment is IR3-off. IR3-on and IR3-off may be determined according to R-set and the type of the item stored in the third item storage compartment; and generally, they meet the relationship of IR3-on>IR3-off.

For the different item storage compartments of the refrigerating chamber, the area refrigeration start temperature thresholds IR1-on, IR2-on and IR3-on may be set to be the same or different; and the area refrigeration stop temperature thresholds IR1-off, IR2-off and IR3-off may be set to be the same or different.

Each item storage compartment may also be pre-configured with a refrigeration state identifier configured to indicate whether air needs to be blown into the item storage compartment or not. For example, the refrigeration identifier of the first item storage compartment is gate 1; the refrigeration identifier of the second item storage compartment is gate 2; and the refrigeration identifier of the third item storage compartment is gate 3. The above-mentioned gate 1, gate 2 and gate 3 can be set as start or stop. For example, "0" represents stop and "1" represents start.

Figure 9:
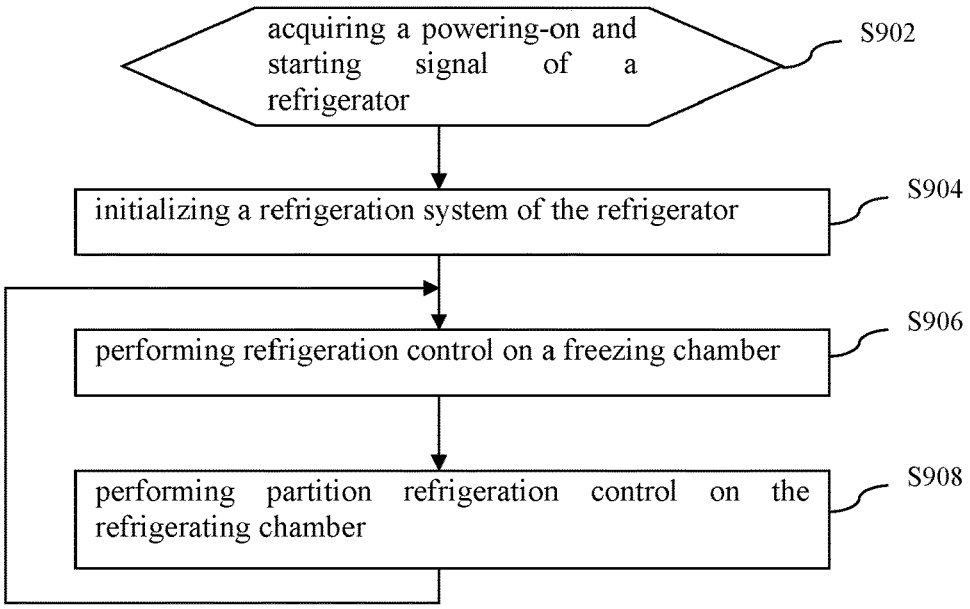
FIG. 9 is a block diagram of an overall flow of a partition refrigeration control method for a refrigerating chamber of a refrigerator according to an embodiment of the present invention.

FIG. 9 is a block diagram of an overall flow of a partition refrigeration control method for a refrigerating chamber of a refrigerator according to an embodiment of the present invention. A refrigeration controller for the refrigerator performs the following steps:

step S902, acquiring a powering-on and starting signal of the refrigerator;

step S904, initializing a refrigeration system of the refrigerator;

step S906, performing refrigeration control on the freezing chamber; and step S908, performing partition refrigeration control on the refrigerating chamber.

After step S908 is completed, the flow returns to step S906 to execute a judgment flow for refrigeration control of the freezing chamber. The above steps will be described in detail below, respectively.

Figure 10:
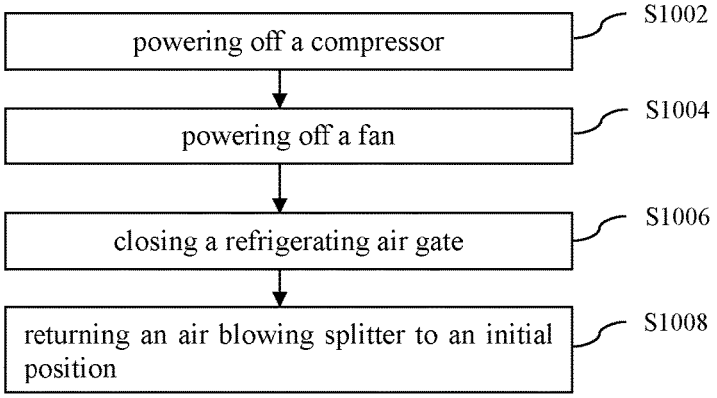
FIG. 10 is a flow chart of the initialization of a refrigeration system of a refrigerator in a partition refrigeration control method for a refrigerating chamber of the refrigerator according to an embodiment of the present invention.

FIG. 10 is a flow chart of the initialization of a refrigeration system of a refrigerator in a partition refrigeration control method for a refrigerating chamber of the refrigerator according to an embodiment of the present invention. The initialization flow comprises the following steps:

step S1002, powering off the compressor to cause the evaporator to stop releasing cold energy;

step S1004, powering off the fan to stop supplying air to the refrigerating chamber;

step S1006, closing the refrigerating air gate to isolate the refrigerating chamber from an evaporator chamber; and step S1008, enabling the split air path blowing device to return to the initial position by enabling, for example, the adjustment part of the split air path blowing device to move to the starting stopper post as shown in FIG. 6.

With the above initialization, the default state may be restored, so that control logic confusion caused by an improper operation of a component during the last power failure is avoided.

Figure 11:
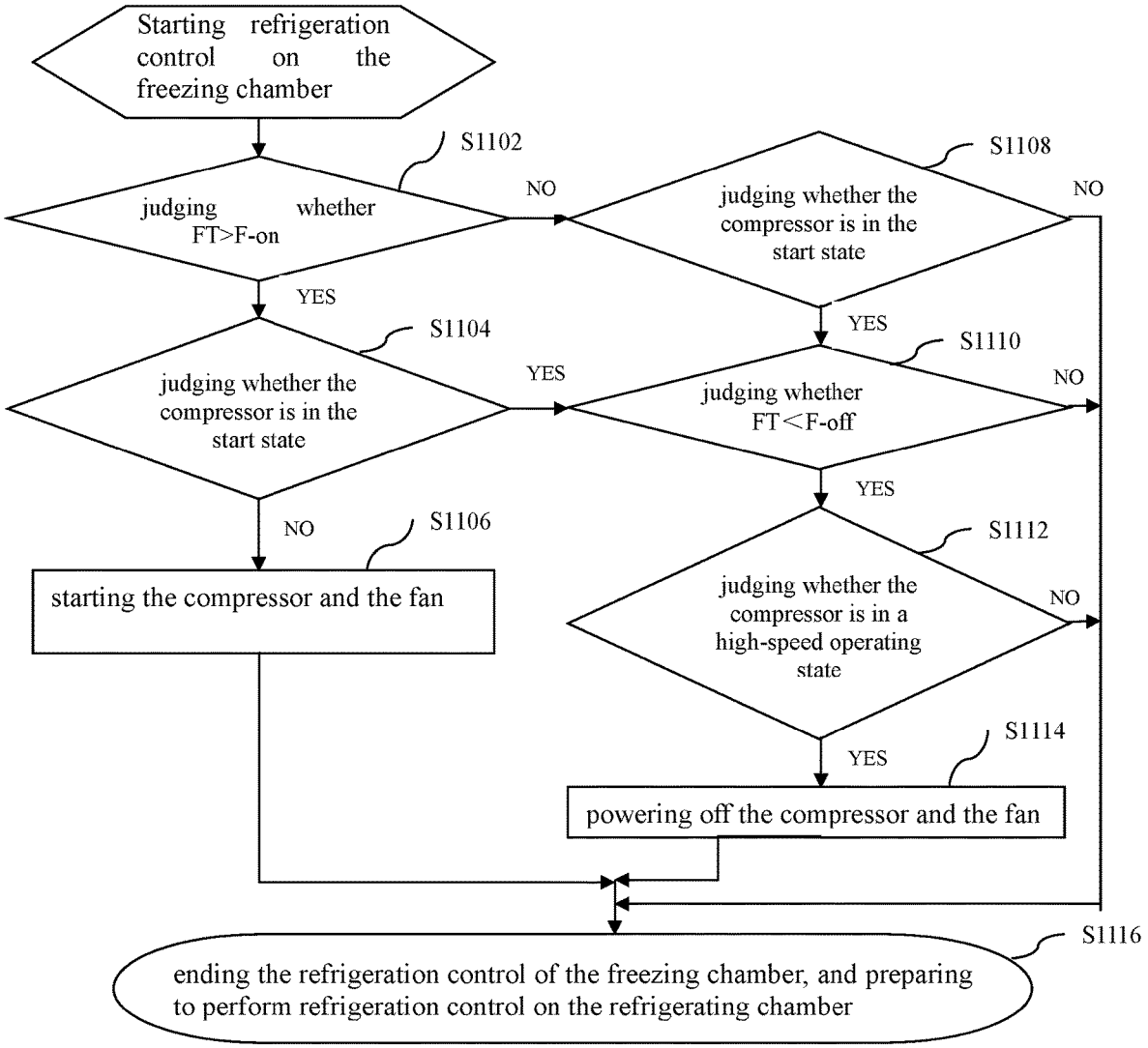
FIG. 11 is a logic flow chart of refrigeration control of a freezing chamber in a partition refrigeration control method for a refrigerating chamber of a refrigerator according to an embodiment of the present invention.

FIG. 11 is a logic flow chart of refrigeration control of a freezing chamber in a partition refrigeration control method for a refrigerating chamber of a refrigerator according to an embodiment of the present invention. After the refrigeration control of the freezing chamber is started, the following steps may be executed:

step S1102, judging whether FT is greater than F-on or not, if yes, executing step S1104, or if not, executing step S1108;

step S1104, judging whether the compressor is in the start state or not, if yes, executing step S1110, or if not, executing step S1106;

step S1106, starting the compressor and the fan;

step S1108, judging whether the compressor is in the start state or not, if yes, executing step S1110, or if not, executing step S1116;

step S1110, judging whether FT is smaller than F-off or not, if yes, executing step S1112, or if not, executing step S1116;

step S1112, judging whether the compressor is in a high-speed operating state or not, if yes, executing step S1116, or if not, executing step S1114;

step S1114, powering off the compressor and the fan; and step S1116, ending the refrigeration control of the freezing chamber, and preparing to perform refrigeration control on the refrigerating chamber.

In FIG. 11, after the control of the start, stop and operating state of the compressor and the fan are completed in the refrigeration control flow of the freezing chamber, the partition refrigeration control of the refrigerating chamber is performed.

Figure 12:
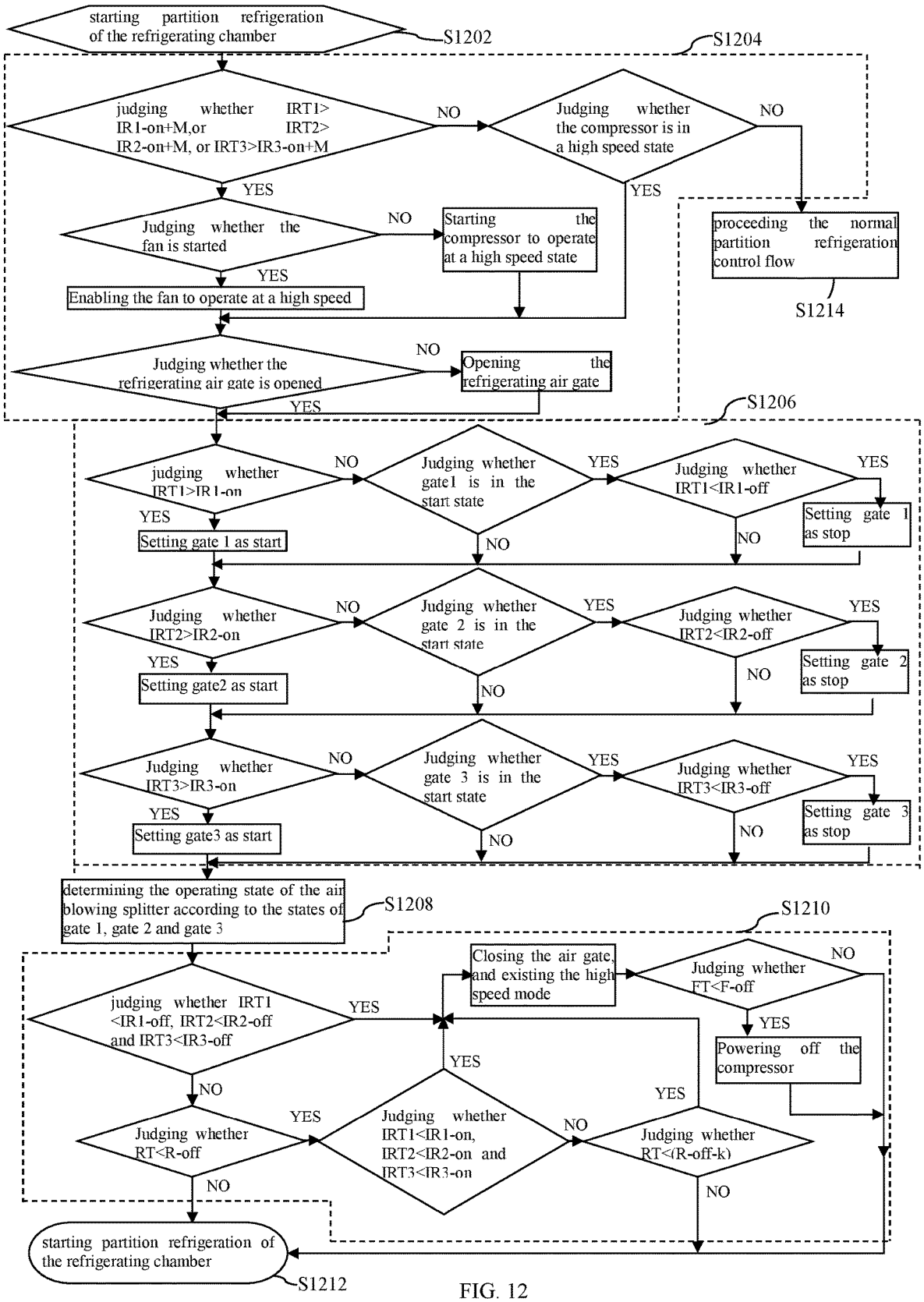
FIG. 12 is a logic flow chart of an accelerated refrigeration flow in a partition refrigeration control method for a refrigerating chamber of a refrigerator according to an embodiment of the present invention.

FIG. 12 is a logic flow chart of an accelerated refrigeration flow in a partition refrigeration control method for a refrigerating chamber of a refrigerator according to an embodiment of the present invention. The accelerated refrigeration flow is suitable for a condition that food with a high temperature is placed in any item storage compartment in the refrigerating chamber of the refrigerator, wherein the temperature of the food may be significantly higher than the compartment temperature and the set temperature R-set of the refrigerating chamber. The accelerated refrigeration flow mainly comprises the following steps.

In step S1202, after the refrigeration control of the freezing chamber is completed, the partition refrigeration of the refrigerating chamber is started. This step may be performed after step S1116 shown in FIG. 11.

In step S1204, the compressor and the fan are driven to operate at a high speed, and the refrigerating air gate is opened. A specific implementation flow of step S1204 comprises: first, judging whether any of conditions IRT1>IR1-on+M, IRT2>IR2-on+M, and IRT3>IR3-on+M exists, wherein M is a preset constant, and represents that there is an item whose temperature is M degrees higher than the refrigeration start temperature threshold of the first item storage compartment, that is, the high temperature item is stored in the first item storage compartment; if yes, driving the fan to operate at a high speed, and enabling the compressor to operate at a high speed; or if not, judging whether the compressor is in a high speed state, if not, executing step S1214, or if yes, directly opening the refrigerating air gate. Each of the processes of driving the fan, the compressor and the refrigerating air gate in step S1204 comprises a state judgment process. If it is determined that the fan, or the compressor, or the refrigerating air gate is already in a required state, there is no need to repeat control. After the compressor and the fan are driven to operate at a high speed and the refrigerating air gate is opened, step S1206 is executed.

In step S1206, refrigeration identifiers are determined through the start temperature thresholds and stop temperature thresholds set for the plurality of item storage compartments. Here, the first item storage space is taken as an example to introduce. Whether IRT1>IR1-on is judged; if yes, gate 1 is set as start, or if not, it is judged that gate 1 is already in the start state; if gate 1 is in the stop state, judgment is performed for the next item storage compartment; if gate 1 is in the start state, whether IRT1<IR1-off is judged; if yes, gate 1 is set as stop and judgment is performed for the next item storage compartment; or if not, judgment is directly performed for the next item storage compartment. For the other item storage compartments such as the second item storage compartment and the third item storage compartment, the judgment process similar to that of the first item storage compartment may be adopted. In FIG. 12, the judgment processes for the three item storage compartments are taken as an example. In an actual use process, the judgment processes can be increased or decreased according to the number of item storage compartments, and the time sequences of the judgment processes of all item storage compartments are not limited, and may be performed one by one or in parallel.

Figure 13:
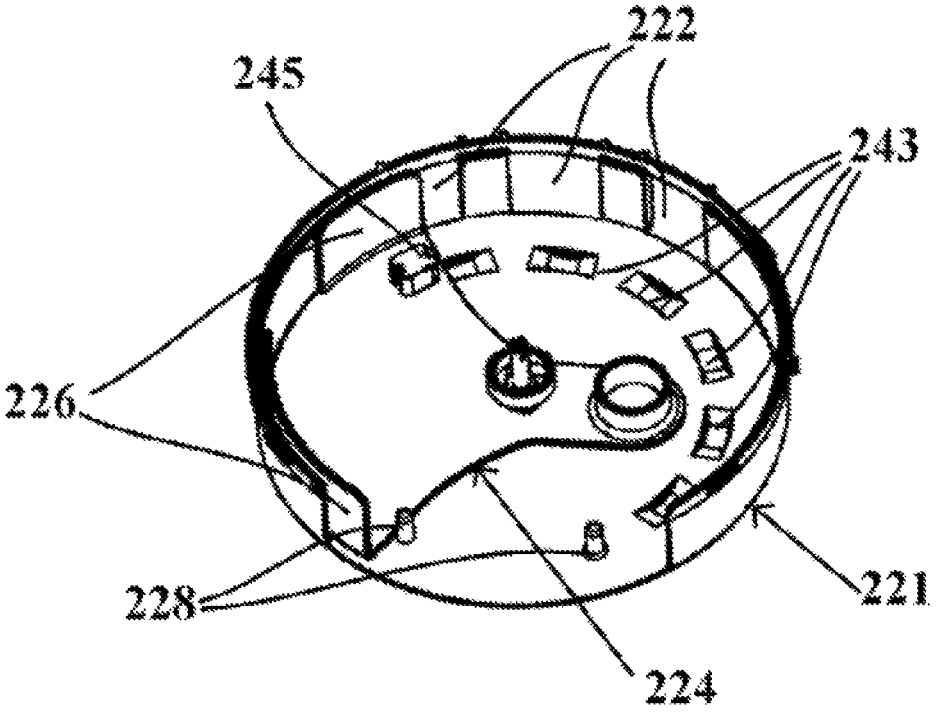
FIGS. 13-20 show multiple operating states of an air blowing splitter in a refrigerator suitable for a partition refrigeration control method for a refrigerating chamber of the refrigerator according to an embodiment of the present invention, respectively.
Figure 14:
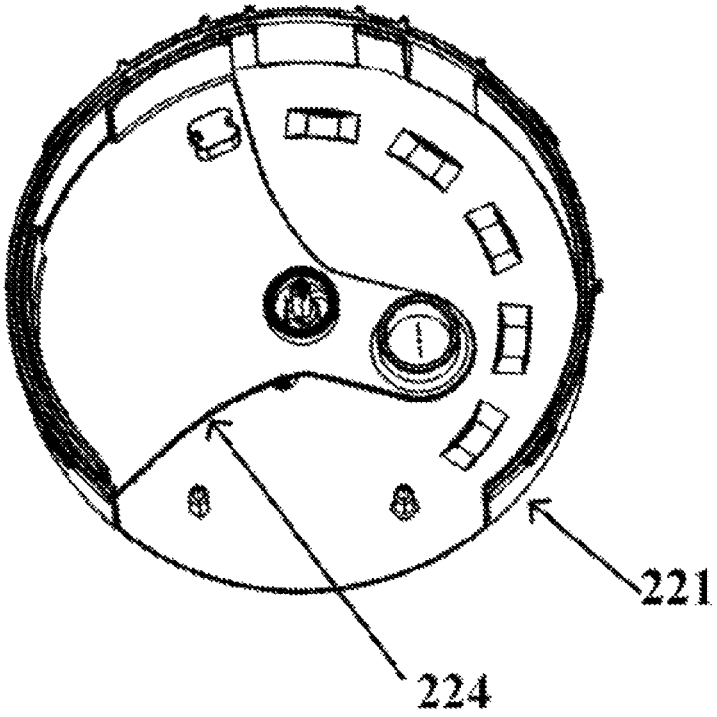
Figure 15:
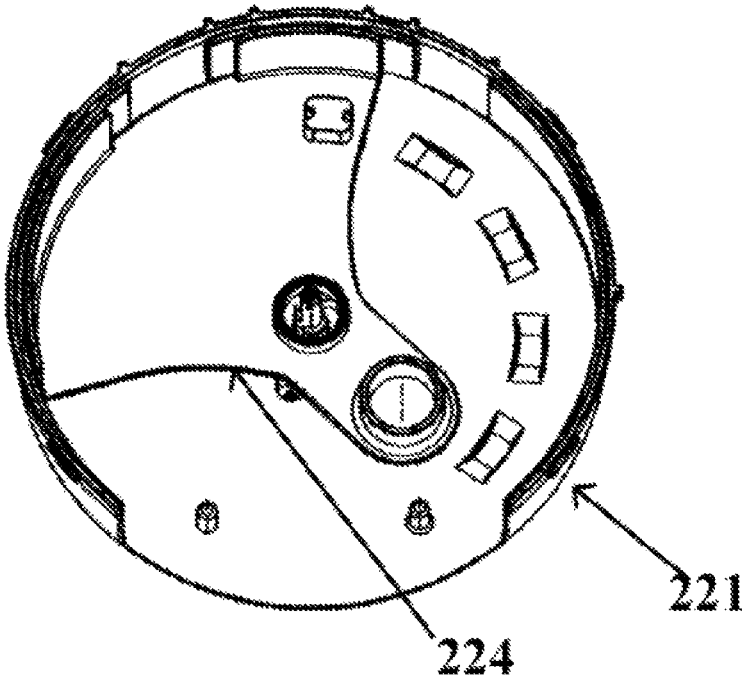
Figure 16:
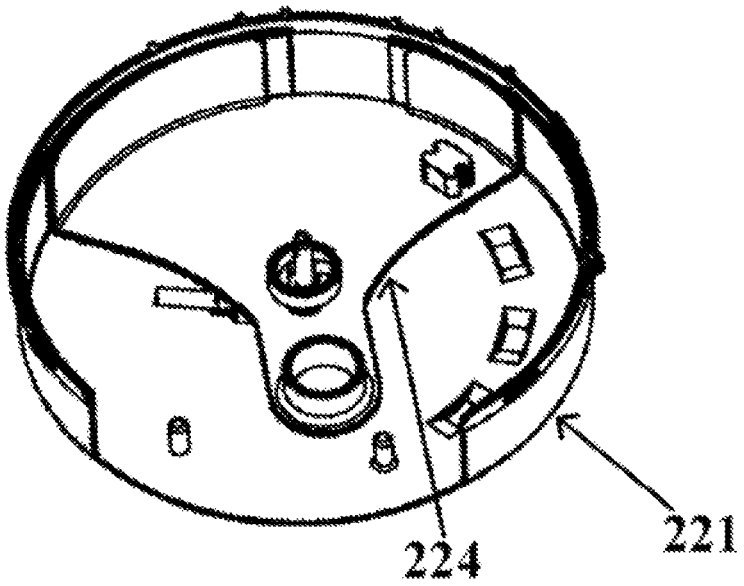
Figure 17:
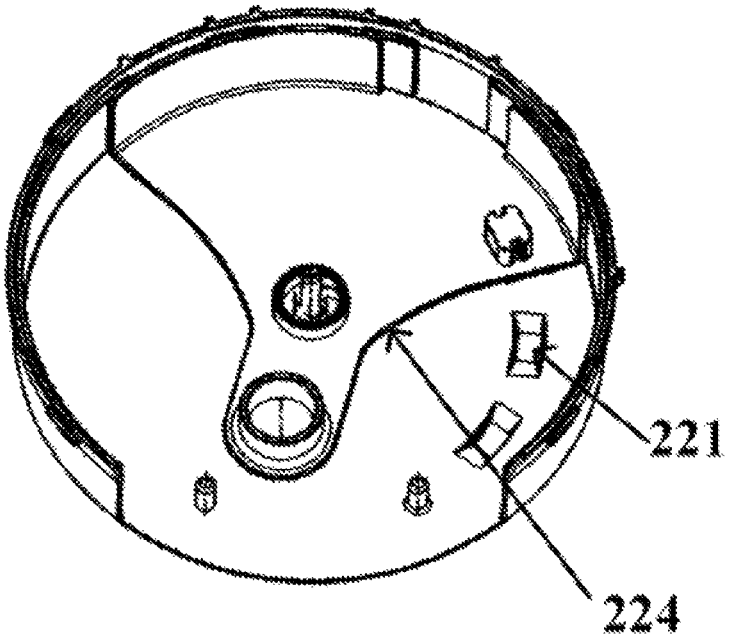
Figure 18:
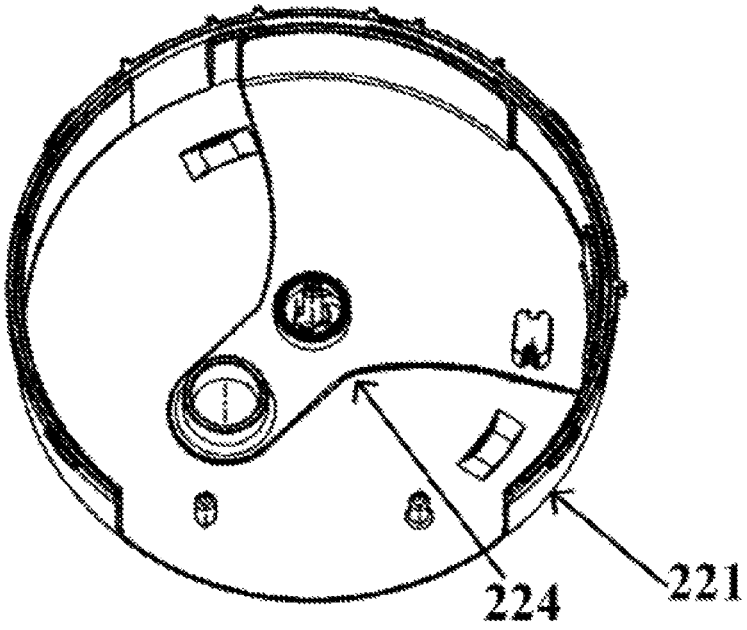
Figure 19:
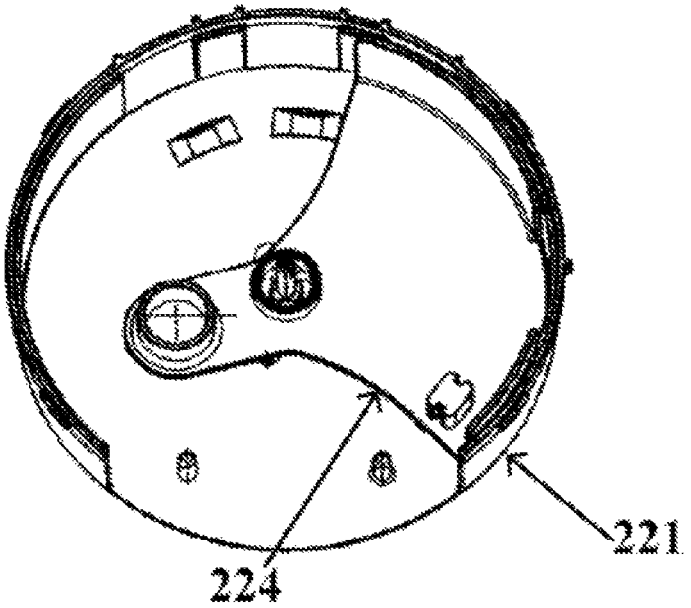
Figure 20:
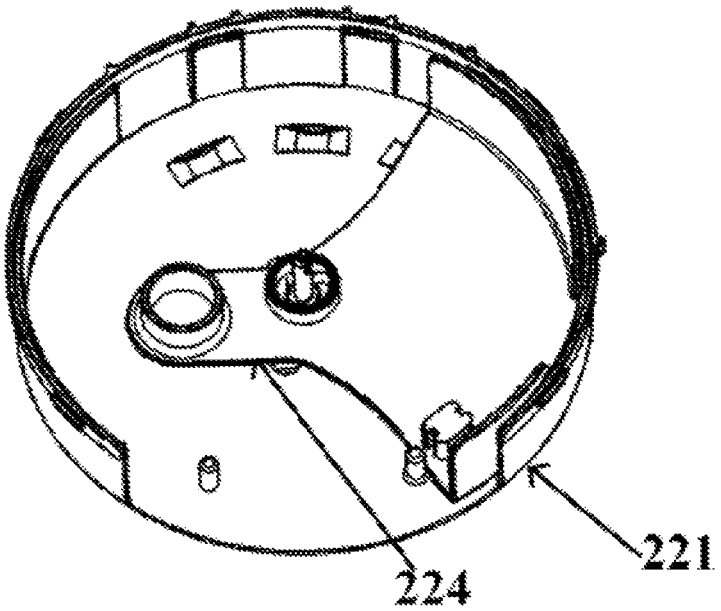

In step S1208, operating states of the air blowing splitter are determined according to the states of gate 1, gate 2, and gate 3 set in step S1206, and the air blowing splitter is driven to operate in this state. FIGS. 13-20 show eight operating states of the air blowing splitter, respectively. FIG. 13 shows an initial state of the air blowing splitter. From the initial state, the adjustment part 224 is controlled to rotate clockwise by a predetermined angle to enable a positioning pin 245 to be inserted into one of the positioning holder recesses 243; and the shielding parts 226 are adopted to shield different distribution ports respectively to enable the cooling air flow to enter the corresponding item storage compartments. FIG. 14 shows a first state of the air blowing splitter, wherein the first distribution port is shielded, and the second distribution port and the third distribution port are opened. FIG. 15 shows a second state of the air blowing splitter, wherein the second distribution port is shielded, and the first distribution port and the third distribution port are opened. FIG. 16 shows a third state of the air blowing splitter, wherein the second distribution port is opened, and the first distribution port and the third distribution port are shielded. FIG. 17 shows a fourth state of the air blowing splitter, wherein the third distribution port is opened, and the first distribution port and the second distribution port are shielded. FIG. 18 shows a fifth state of the air blowing splitter, wherein the first distribution port is opened, and the second distribution port and the third distribution port are shielded. FIG. 19 shows a sixth state of the air blowing splitter, wherein the first and second distribution ports are opened, and the third distribution port is shielded. FIG. 20 is the seventh state of the air blowing splitter, wherein the adjustment part 224 is abutted against the other stopper post, and all of the first, second and third distribution ports are opened.

Table 2 shows corresponding relationships between set operating states of the air blowing splitter for partition refrigeration of the refrigerating chamber having three item storage compartments and refrigeration identifiers of all item storage compartments.

TABLE 2

| Refrigeration identifier of item storage compartment | State 1 | State 2 | State 3 | State 4 | State 5 | State 6 | State 7 |
|---|---|---|---|---|---|---|---|
| gate 1 | Off | On | Off | Off | On | On | On |
| gate 2 | On | Off | On | Off | Off | On | On |
| gate 3 | On | On | Off | On | Off | Off | On |

In table 2, "on" represents that the refrigeration identifier is correspondingly started, and "off" represents that the refrigeration identifier is correspondingly stopped. According to the above description, in the present embodiment, the states of the air blowing splitter may be adjusted if there are two or more than three item storage compartments.

In step S1210, whether the accelerated refrigeration flow is completed or not is judged according to the refrigeration condition. A specific implementation flow of step S1210 comprises: first, judging whether the temperature of a current item storage spaces satisfies IRT1<IR1-off, IRT2<IR2-off and IRT3<IR3-off at the same time or not; if yes, closing the air gate and exiting the high rotation state, or if not, judging whether RT is smaller than R-off or not; if not, proceeding to step S1212, or if yes, judging whether the temperature of the item storage spaces satisfies IRT1<IR1-on, IRT2<IR2-on and IRT3<IR3-on at the same time or not; if yes, similarly, closing the air gate and exiting the high rotation state, or if not, judging whether RT is smaller than (R-off-k), that is, judging whether the average environment temperature RT in the refrigerating chamber is k degrees lower than R-off or not, k being a preset constant; if yes, closing the air gate and exiting the high rotation state, or if not, proceeding to step S1212. After the air gate is closed and the high speed mode is exited, whether the temperature FT of the freezing chamber satisfies FT<F-off or not can be judged; if yes, the compressor is powered off, and step S1212 is proceeded; or if not, step S1212 is directly proceeded.

In step S1212, the refrigeration control process of the freezing chamber is returned. For example, it returns to step S1102.

In step S1214, the normal partition refrigeration control flow is executed.

Figure 21:
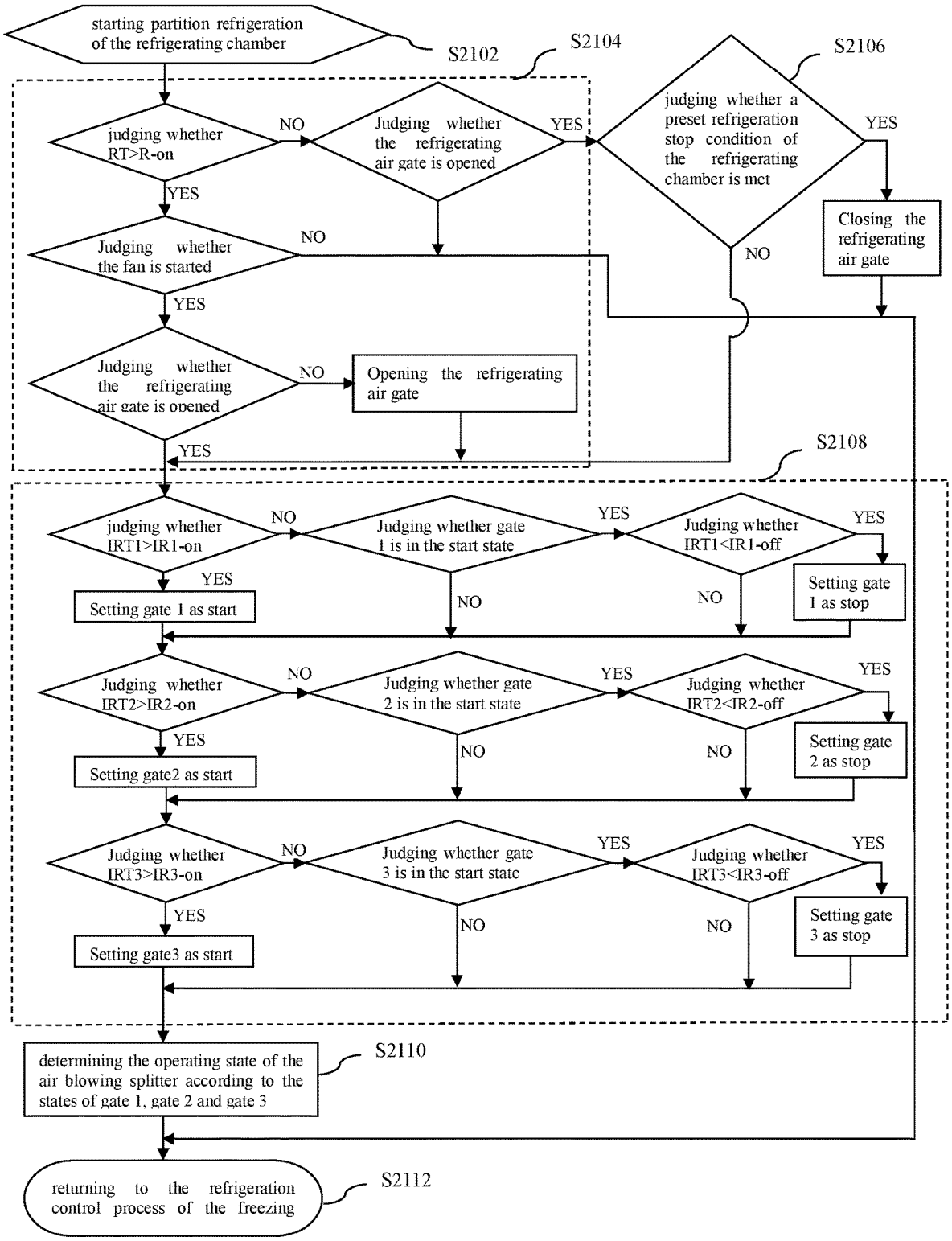
FIG. 21 is a logic flow chart of a normal refrigeration flow in a partition refrigeration control method for a refrigerating chamber of a refrigerator according to an embodiment of the present invention.

FIG. 21 is a logic flow chart of a normal refrigeration flow in a partition refrigeration control method for a refrigerating chamber of a refrigerator according to an embodiment of the present invention. The normal refrigeration flow is suitable for a condition that an average temperature of the refrigerating chamber of the refrigerator is increased, and refrigeration is performed based on the situation of an item storage compartment. The normal refrigeration flow mainly comprises the following steps.

In step S2102, partition refrigeration of the refrigerating chamber is started, and this step may be performed after step S1214 shown in FIG. 12.

In step S2104, the fan and the refrigerating air gate are driven to be started. A specific implementation flow of step S2104 comprises: judging whether RT is greater than R-on or not first; if RT is greater than R-on, judging whether the fan is started or not; if the fan is started, enabling the refrigerating air gate to be in a start state, and then directly proceeding to step S2108; if the fan is not started, returning to step S2112; if RT is smaller than or equal to R-on, judging whether the refrigerating air gate is in the start state or not; if yes, proceeding to step S2104; or if not, returning to step S2112.

In step S2106, whether the average environment temperature in the refrigerating chamber and/or the temperature of the article in each storage space meet(s) a preset refrigeration stop condition of the refrigerating chamber or not is judged; if yes, the refrigerating air gate is closed, and then directly return to step S2112; or if not, step S2108 is executed.

In step S2108, the refrigeration identifiers are determined according to the start temperature thresholds and stop temperature thresholds set for the plurality of item storage compartments. This step is basically the same as the judgment flow in step S1206 shown in FIG. 12, and is implemented by judging the plurality of item storage compartments, respectively, and determining the refrigeration identifier of each item storage compartment.

In step S2110, the operating states of the air blowing splitter are determined according to the states of gate 1, gate 2, and gate 3 set in step S2108, and the air blowing splitter is driven to operate in this state. This step is basically the same as the flow of step S1208 shown in FIG. 12. The corresponding relationships between the operating states of the air blowing splitter and the gate 1, gate 2 and gate 3 are shown in Table 2.

In step S2112, return to the refrigeration control process of the freezing chamber. For example, return to step S1102.

Figure 22:
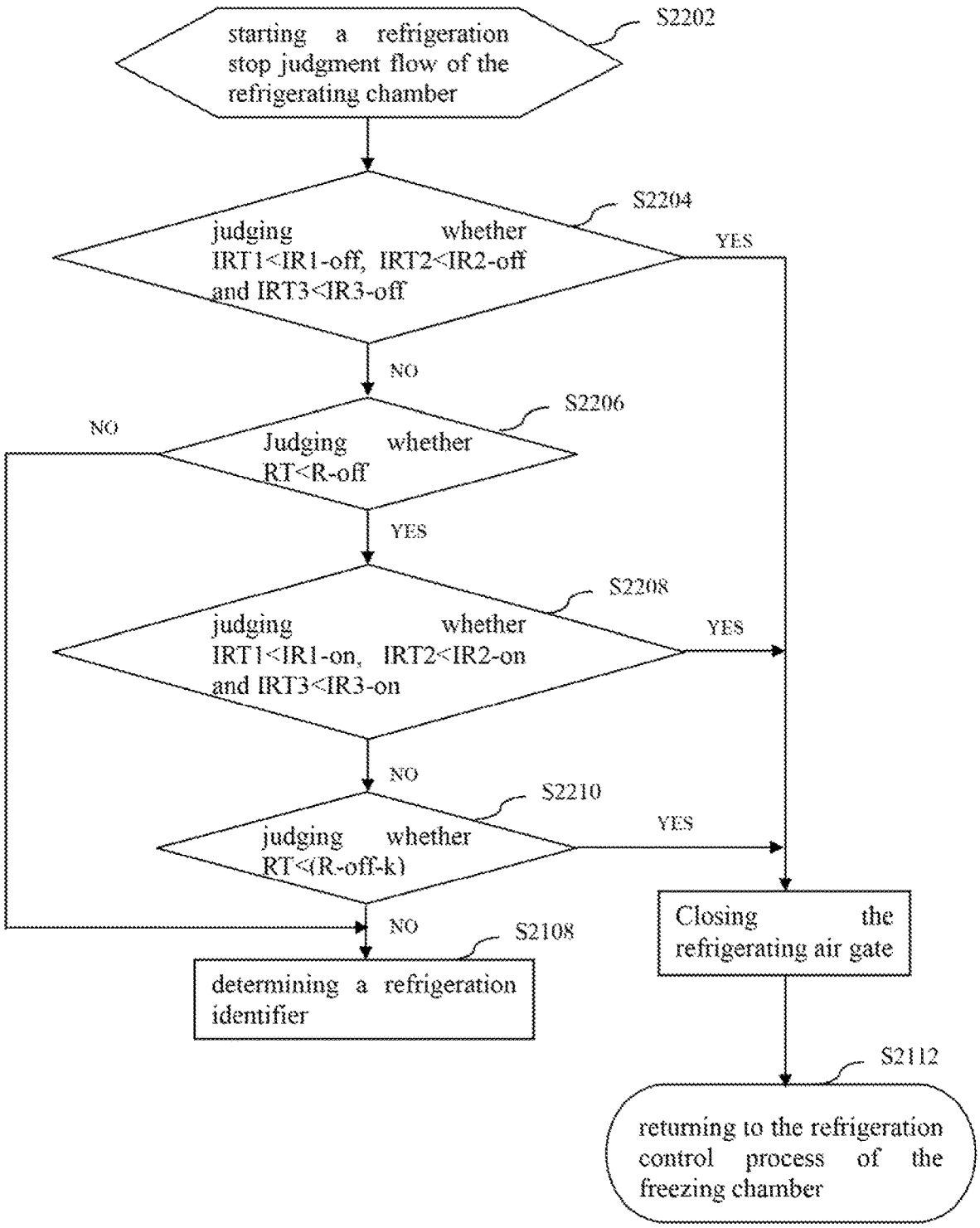
FIG. 22 is a logic flow chart of determination of refrigeration stop in a partition refrigeration control method for a refrigerating chamber of a refrigerator according to an embodiment of the present invention.

There are multiple refrigeration stop conditions for the refrigerating chamber used in step S2106. FIG. 22 is a logic flow chart of determination of refrigeration stop in a partition refrigeration control method for a refrigerating chamber of a refrigerator according to an embodiment of the present invention. After a refrigeration stop judgment flow of the refrigerating chamber is started in step S2202, the following steps are performed sequentially.

In step S2204, whether IRT1<IR1-off, IRT2<IR2-off and IRT3<IR3-off are satisfied at the same time or not are judged; if yes, the refrigerating air gate is closed and step S2112 in FIG. 21 is executed; or if not, step S2206 is executed.

In step S2206, whether RT is smaller than R-off or not is judged, that is, whether the average environment temperature in the refrigerating chamber is lower than the preset stop temperature threshold or not is judged; if yes, the judgment flow in step S2208 is executed; and if not, step S2108 shown in FIG. 21 is directly executed.

In step S2208, whether IRT1<IR1-on, IRT2<IR2-on and IRT3<IR3-on are satisfied at the same time or not are judged; if yes, the refrigerating air gate is closed and step S2112 in FIG. 21 is executed; or if not, the judgment flow in step S2210 is executed.

In step S2210, whether RT is smaller than (R-off-k) or not is judged, that is, the average environment temperature RT in the refrigerating chamber is k degrees lower than R-off or not is judged, in other words, whether a difference value obtained by subtracting RT from R-off is greater thank or not is judged, k being a preset constant and representing a preset margin value; if yes, the refrigerating air gate is closed, and step S2112 shown in FIG. 21 is executed; or if not, step S2108 shown in FIG. 21 is directly executed.

FIG. 22 shows an optional refrigeration stop condition of the refrigerating chamber. In some optional simple judgment flows, only the steps of S2204 and S2206 need to be executed. If it is determined that RT is smaller than R-off, step S2112 shown in FIG. 21 is executed; or if RT is greater than or equal to R-off, step S2108 shown in FIG. 21 is executed directly, and steps S2208 and S2210 are omitted. Tests show that the refrigeration stop condition without the omitted steps can also achieve the control effect, but its effect is inferior to that of the complete flow shown in FIG. 22.

By illustrating the partition refrigeration control method for the refrigerating chamber of the refrigerator in the above specific embodiment, it can be seen that the partition refrigeration control method is suitable for various conditions of multiple item storage compartments, and effectively meets requirements on refrigeration control of the refrigerating chamber. It should be noted that the present method is not limited to control of a refrigerating chamber having three item storage compartments, and is also suitable for split air blowing and refrigeration control of a refrigerating chamber having two item storage compartments or more than three item storage compartments by simple deformation.

The partition refrigeration control method and device for the refrigerating chamber of the refrigerator provided by the present embodiment are suitable for a case where the refrigerating chamber of the refrigerator is divided into the plurality of item storage compartments. After the refrigerating chamber enters the refrigeration state, the infrared sensor is adopted to sense the temperatures of the items stored in the plurality of item storage compartments; the position and the temperature of a heat source in the refrigerator are accurately determined by receiving infrared radiation energy released from the items placed in the refrigerator; and the sensed temperatures of the items stored in the refrigerator are compared with the preset area refrigeration start temperature thresholds thereof, and a refrigeration state of each item storage compartment is determined in accordance with the comparison results. As the air blowing splitter distributes the cooling air flow to respective item storage compartments in accordance with the refrigeration state thereof, the control is more precise. Therefore, refrigeration control according to a condition of the item stored in the corresponding item storage compartment is ensured, and electric energy waste caused by refrigeration of the whole refrigerating chamber is avoided. Further, the partition refrigeration control method and device for the refrigerating chamber of the refrigerator provided by the present embodiment may quickly cool an item with a relatively higher temperature, and reduce the influence of the item with the relatively higher temperature on other items already stored in the refrigerator, so that the storage effect of the refrigerating chamber of the refrigerator is improved, and nutrient loss of food is reduced. Furthermore, in the partition refrigeration control method and device for the refrigerating chamber of the refrigerator provided by the present embodiment, a refrigeration mode of the refrigerating chamber is correspondingly adjusted by comprehensively judging the entire environment temperature in the refrigerating chamber and the temperature of the item stored in each item storage compartment, so that the refrigeration control flexibility of the refrigerating chamber is improved, and the requirements of different using habits of users are met.

Heretofore, although multiple embodiments of the present invention have been illustrated and described in detail, those skilled in the art may make various modifications and variations to the present invention based on the content disclosed by the present invention or the content derived therefrom without departing from the spirit and scope of the present invention. Thus, the scope of the present invention should be understood and deemed to include these and other modifications and variations.

What is claimed is:

1. A partition refrigeration control method for a refrigerating chamber of a refrigerator, wherein the refrigerating chamber is divided into a plurality of item storage compartments; an infrared sensor for sensing temperatures of items stored in the item storage compartments respectively is arranged in the refrigerating chamber; the refrigerator is provided with an air blowing splitter configured to distribute a cooling air flow from a cold source to the plurality of item storage compartments; and the partition refrigeration control method comprises:

determining that the refrigerating chamber enters a refrigeration state;

acquiring the temperatures, sensed by the infrared sensor, of the items stored in the plurality of item storage compartments;

comparing the temperature of the items stored in each item storage compartment with a corresponding preset area refrigeration start temperature threshold of each item storage compartment;

setting a refrigeration state identifier corresponding to the item storage compartment in which the temperature of the item is higher than the corresponding area refrigeration start temperature threshold as start; and driving the air blowing splitter to operate in a state of providing the cooling air flow to the item storage compartment whose refrigeration state identifier is start.

2. The method according to claim 1, wherein the refrigerating chamber is further provided with a refrigerating environment temperature sensor configured to sense an average environment temperature in the refrigerating chamber, and the step of determining that the refrigerating chamber enters the refrigeration state further comprises:

acquiring the average environment temperature in the refrigerating chamber;

judging whether the average environment temperature in the refrigerating chamber is higher than or equal to a preset overall refrigeration start temperature threshold; and if yes, opening a refrigerating air gate arranged between the cold source and the air blowing splitter to enable the refrigerating chamber to enter the refrigeration state.

3. The method according to claim 2, wherein:

whether the refrigerating air gate is already in an open state or not is judged when the average environment temperature in the refrigerating chamber is less than the preset overall refrigeration start temperature threshold;

if yes, whether the average environment temperature in the refrigerating chamber and/or the temperature of the item in each item storage compartment meet(s) a preset refrigeration stop condition of the refrigerating chamber or not is judged; and if the preset refrigeration stop condition of the refrigerating chamber is met, the refrigerating air gate is closed.

4. The method according to claim 3, wherein the refrigeration stop condition of the refrigerating chamber comprises:

the temperature of the item stored in each item storage compartment being less than the corresponding preset area refrigeration start temperature threshold of each item storage compartment, wherein the area refrigeration stop temperature threshold of each item storage compartment is less than the corresponding area refrigeration start temperature threshold; or the average environment temperature in the refrigerating chamber being less than the preset overall refrigeration stop temperature threshold.

5. The method according to claim 3, wherein the refrigeration stop condition of the refrigerating chamber comprises:

the temperature of the item stored in each item storage compartment being less than the corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

6. The method according to claim 1, wherein after the step of comparing the temperature of the item stored in each item storage compartment with the preset area refrigeration start temperature threshold of each item storage compartment, the method further comprises:

comparing the temperature of the item stored in each item storage compartment with a corresponding preset area refrigeration stop temperature threshold of each item storage compartment, wherein the area refrigeration stop temperature threshold of each item storage compartment is smaller than the area refrigeration start temperature threshold thereof; and setting the refrigeration state identifier corresponding to the item storage compartment in which the temperature of the item is less than the corresponding area refrigeration stop temperature threshold as stop.

7. The method according to claim 1, wherein before the step of determining that the refrigerating chamber enters the refrigeration state, the method further comprises:

acquiring a powering-on and starting signal of the refrigerator; and initializing a refrigeration system of the refrigerator, the refrigeration system comprising: a compressor, the refrigerating air gate, a fan and the air blowing splitter.

8. The method according to claim 7, wherein the step of initializing the refrigeration system of the refrigerator comprises:

powering off the compressor and the fan, closing the refrigerating air gate, and driving the air blowing splitter to operate to an initial position.

9. The method according to claim 8, wherein the refrigerator further comprises a freezing chamber; and after the step of initializing the refrigeration system of the refrigerator, the method further comprises:

judging whether or not to perform refrigeration on the freezing chamber according to an acquired temperature of the same, so as to adjust a start/stop state of the compressor, the fan and the refrigerating air gate; and after the completion of the refrigeration judgment of the freezing chamber, starting the step of determining that the refrigerating chamber enters the refrigeration state.

10. A partition refrigeration control device for a refrigerating chamber of a refrigerator, wherein the refrigerating chamber is divided into a plurality of item storage compartments; an infrared sensor for sensing temperatures of items stored in the item storage compartments respectively is arranged in the refrigerating chamber; the refrigerator is provided with an air blowing splitter configured to distribute a cooling air flow from a cold source to the plurality of item storage compartments; and the partition refrigeration control device comprises:

a state determination module configured to determine that the refrigerating chamber enters a refrigeration state;

a first temperature acquisition module configured to acquire the temperatures, sensed by the infrared sensor, of the items stored in the plurality of item storage compartments;

a first comparison module configured to compare the temperature of the items stored in each item storage compartment with a corresponding preset area refrigeration start temperature threshold of each item storage compartment;

an identifier setting module configured to set a refrigeration state identifier corresponding to the item storage compartment in which the temperature of the item is higher than the corresponding area refrigeration start temperature threshold as start; and a driving module configured to drive the air blowing splitter to operate in a state of providing the cooling air flow to the item storage compartment whose refrigeration state identifier is start.

11. The partition refrigeration control device according to claim 10, wherein the refrigerating chamber is further provided with a refrigerating environment temperature sensor configured to sense an average environment temperature in the refrigerating chamber; and the partition refrigeration control device further comprises:

a second temperature acquisition module configured to acquire the average environment temperature in the refrigerating chamber;

an environment temperature judgment module configured to judge whether the average environment temperature in the refrigerating chamber is higher than or equal to a preset overall refrigeration start temperature threshold or not; and an air gate control module configured to open a refrigerating air gate arranged between the cold source and the air blowing splitter to enable the refrigerating chamber to enter the refrigeration state if a judgment result of the environment temperature judgment module is YES.

12. The partition refrigeration control device according to claim 11, wherein the air gate control module is further configured to:

judge whether the refrigerating air gate is already in an open state or not when the average environment temperature in the refrigerating chamber is less than the preset overall refrigeration start temperature threshold;

if yes, judge whether the average environment temperature in the refrigerating chamber and/or the temperature of the item in each item storage compartment meet(s) a preset refrigeration stop condition of the refrigerating chamber or not; and if the preset refrigeration stop condition of the refrigerating chamber is met, close the refrigerating air gate.

13. The partition refrigeration control device according to claim 12, wherein the refrigeration stop condition of the refrigerating chamber comprises:

the temperature of the item stored in each item storage compartment being less than a corresponding preset area refrigeration stop temperature threshold of each item storage compartment, wherein the area refrigeration stop temperature threshold of each item storage compartment is less than the corresponding area refrigeration start temperature threshold; or the average environment temperature in the refrigerating chamber being less than a preset overall refrigeration stop temperature threshold.

14. The partition refrigeration control device according to claim 12, wherein the refrigeration stop condition of the refrigerating chamber comprises:

the temperature of the item stored in each item storage compartment being less than the corresponding preset area refrigeration start temperature threshold of each item storage compartment when the average environment temperature in the refrigerating chamber is less than the preset overall refrigeration stop temperature threshold, wherein the area refrigeration stop temperature threshold of each item storage compartment is less than the corresponding area refrigeration start temperature threshold; or a difference value obtained by subtracting the average environment temperature in the refrigerating chamber from the preset overall refrigeration stop temperature threshold being greater than a preset margin value.

15. The partition refrigeration control device according to claim 10, further comprising:

a second comparison module configured to compare the temperature of the item stored in each item storage compartment with a corresponding preset area refrigeration stop temperature threshold of each item storage compartment, wherein the area refrigeration stop temperature threshold of each item storage compartment is smaller than the area refrigeration start temperature threshold thereof; and the identifier setting module is further configured to set the refrigeration state identifier corresponding to the item storage compartment in which the temperature of the item is less than the corresponding area refrigeration stop temperature threshold as stop.

16. The partition refrigeration control device according to claim 10, further comprising:

an initialization module configured to acquire a powering-on and starting signal of the refrigerator, and initialize a refrigeration system of the refrigerator, the refrigeration system comprising: a compressor, the refrigerating air gate, a fan and the air blowing splitter.

17. The partition refrigeration control device according to claim 16, wherein the initialization module is further configured to:

power off the compressor and the fan, close the refrigerating air gate, and drive the air blowing splitter to operate to the initial position.

18. The partition refrigeration control device according to claim 17, wherein the refrigerator further comprises a freezing chamber; the partition refrigeration control device further comprises a third temperature acquisition module configured to acquire a temperature of the freezing chamber, judge whether or not to perform refrigeration on the freezing chamber according to the acquired temperature of the same so as to adjust a start/stop state of the compressor, the fan and the refrigerating air gate; and the state determination module is further configured to start the step of determining that the refrigerating chamber enters the refrigeration state after the completion of the refrigeration judgment of the freezing chamber.

* * * * *